US005398528A

United States Patent [19]

Johnston et al.

[11] Patent Number: 5,398,528

[45] Date of Patent: Mar. 21, 1995

[54] PULLEY SYSTEM FOR AUTOMATIC WASHER

[75] Inventors: Vonda K. Johnston, Ann Arbor; Joseph H. Zahrn, Jr., Berrien Springs; Victor W. Cuthbert, Sodus Township, Berrien County; Jean-Paul D. Merlin, Lincoln Township, Berrien County; Brenner M. Sharp, St. Joseph, all of Mich.

[73] Assignee: Whirlpool Corporation, Benton Harbor, Mich.

[21] Appl. No.: 236,814

[22] Filed: May 2, 1994

[51] Int. Cl.[6] ..... D06F 37/38

[52] U.S. Cl. ..... 68/24; 690/140; 690/210; 690/142

[58] Field of Search ..... 68/58, 24, 3 R, 140, 68/142, 143, 210, 139, 144; 192/139, 116.5

[56] References Cited

U.S. PATENT DOCUMENTS

| | | | |
|---|---|---|---|
| 1,077,043 | 10/1913 | Darrow | 68/140 X |
| 1,885,656 | 7/1932 | Watson | 68/144 |
| 1,947,785 | 2/1934 | Harlan | 68/140 |
| 2,479,153 | 8/1949 | Buss | 68/179 |
| 2,571,197 | 10/1961 | Buss | 68/143 |
| 3,240,382 | 3/1966 | Files | 220/41 |
| 3,280,603 | 10/1966 | Schwamm | 68/139 |
| 3,477,259 | 11/1969 | Bannish et al. | 68/140 X |
| 3,645,117 | 2/1972 | Larson | 68/140 |
| 3,889,496 | 6/1975 | Heyne | 68/140 |
| 3,939,729 | 2/1976 | Brockelsby | 74/575 |
| 4,862,712 | 9/1989 | Huttemann | 68/17 |
| 5,207,456 | 12/1993 | Nukaga et al. | 68/140 |

FOREIGN PATENT DOCUMENTS

| | | | |
|---|---|---|---|
| 253250 | 9/1987 | European Pat. Off. | D06F 21/02 |
| 347393 | 6/1993 | European Pat. Off. | D06F 37/30 |
| 1610073 | 12/1978 | Germany | 68/140 |
| 3431807 | 8/1984 | Germany | D06F 37/30 |

*Primary Examiner*—Frankie L. Stinson

*Attorney, Agent, or Firm*—Joel M. Van Winkle; Stephen D. Krefman

[57] ABSTRACT

A pulley system for an automatic washer wherein the automatic washer includes a wash basket rotatably disposed within a tub and a motor having a motor shaft for selectively rotating the wash basket about a horizontal axis. The pulley system is disposed between the motor and the basket for drivingly connecting the motor with the basket and includes a drive hub disposed external of the tub drivingly interconnected with the wash basket. A pulley having an inner surface slidably disposed about the outer diameter of the drive hub is provided such that the pulley may rotate a predetermined angular distance about the hub before drivingly engaging the drive hub for co-rotation. A trip arm is interconnected with the drive hub and the pulley and is adapted for selective partial extension beyond the outer periphery of the pulley in response to the direction of wash basket rotation. A belt is drivingly disposed about the motor shaft and the pulley for drivingly interconnecting the motor with the pulley.

15 Claims, 14 Drawing Sheets

18
32
12e
64
10
30
14
55a
22
16
34
12
12a
12c

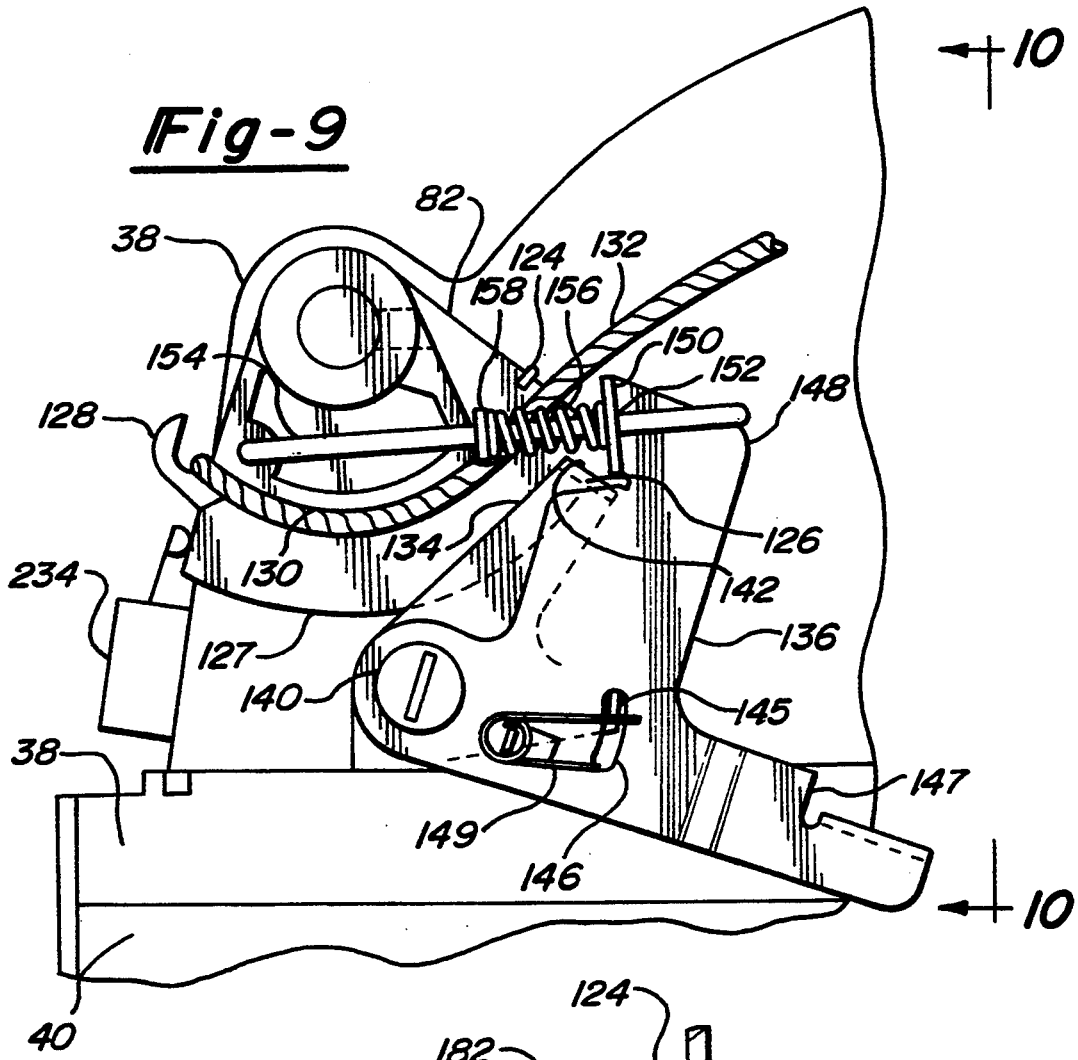
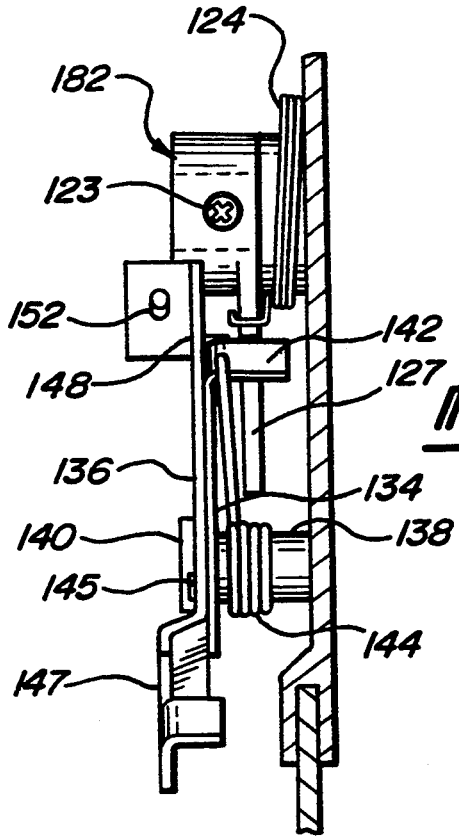
Fig-10

PULLEY SYSTEM FOR AUTOMATIC WASHER

BACKGROUND OF THE INVENTION

The present invention relates to a top-loading horizontal axis automatic washer having a tub with an opening and a rotatable basket disposed within the tub, the basket having door flaps, and more particularly, to a pulley system for actuating and resetting a system for positioning the basket within the tub in a loading position wherein the basket doors are aligned with the tub opening.

Typically, horizontal axis automatic washers employ either a front loading or a top loading configuration for receiving clothes items to be washed. U.S. Pat. No. 3,197,980 to Marple, assigned to the assignee of the present invention, shows a typical front loading horizontal washer wherein the horizontal wash basket is accessed through one of the vertical end walls of the horizontal basket and the front surface of the washer enclosure.

The preference of many consumers, however, particularly those in the U.S., is for top loading washers. Existing top loading horizontal axis washers, however, have some drawbacks. In the typical top-loading horizontal washer, the rotatable wash basket must be manually positioned by the user for alignment with a tub opening for accessing the interior of the wash basket. U.S. Pat. No. 3,927,542 illustrates such a washer wherein no automatic wash basket positioning system is provided.

U.S. Pat. No. 4,862,712 discloses a top-loading horizontal washing machine having a system for locking a rotatable basket in an upright position responsive to opening a cabinet lid of the washer. In this reference, responsive to opening the cabinet lid, a feeler is positioned against a pulley which is drivingly connected to the wash basket, during basket positioning. The drive motor is deenergized when the feeler engages a recess on the pulley which corresponds to a upright basket position wherein the basket doors are aligned with a tub opening. In this fashion, the basket is automatically positioned for loading and unloading when the cabinet lid is opened.

Several other references, such as European Patent 253,250 and U.S. Pat. No. 2,571,197, disclose the concept of positioning a rotatable basket by stopping the drive motor of the basket in response to sensing the rotational position of pulleys or arms rotationally associated with the basket.

The above described positioning systems, however, all contain disadvantages. One disadvantage is that the systems for sensing the basket rotational position are relatively complicated and relatively costly. Another disadvantage of the above cited prior art is that no system is provided for positively engaging the wash basket. Another disadvantage is that the prior art systems disclosed for sensing basket position require selective electromechanical actuation of feeler elements to engage an element, such as a pulley, which is rotationally associated with the basket.

There exists, therefore, a need for a top loading horizontal axis washer having an improved, more reliable, and less costly system for identifying the rotational position of the basket within a tub such that the wash tub may be positioned in an upright position. More specifically, there exists a need for a pulley system which can selectively actuate a positioning/holding system for a rotatable wash basket wherein the pulley system is relatively inexpensive and reliable.

SUMMARY OF THE INVENTION

One object of the invention is to automatically position a wash basket in a top loading horizontal axis washer in an upright position for loading and unloading.

Another object is to automatically actuate and reset a system for holding/positioning a wash basket in a top loading horizontal axis washer in an upright position.

Another object is to provide a pulley system for selectively actuating and resetting a positioning/holding system for a horizontal wash basket.

Still another object is to provide a pulley system having a trip arm with may be selectively extended beyond the outer periphery of the pulley for engaging a latching mechanism wherein selective engagement of the latching mechanism operates in one mode to position and hold a rotatable wash basket in an upright position and in another mode to release the the basket for free rotation.

According to the present invention, the foregoing and other objects are attained by an automatic washer having a pulley system wherein the automatic washer includes a wash basket rotatably disposed within a tub and a motor having a motor shaft for selectively rotating the wash basket about a horizontal axis. The pulley system is disposed between the motor and the basket for drivingly connecting the motor with the basket and includes a drive hub disposed external of the tub drivingly interconnected with the wash basket. A pulley having an inner surface slidably disposed about the outer diameter of the drive hub is provided such that the pulley may rotate a predetermined angular distance about the hub before drivingly engaging the drive hub for co-rotation. A trip arm is interconnected with the drive hub and the pulley and is adapted for selective partial extension beyond the outer periphery of the pulley in response to the direction of wash basket rotation. A belt is drivingly disposed about the motor shaft and the pulley for drivingly interconnecting the motor with the pulley.

The pulley system further includes a drive dog extending inwardly from the inner diameter of the pulley for riding within a slot formed into the outer diameter of the drive hub wherein engagement between the drive dog and one of the end walls of the slot causes driving engagement between the pulley and the drive hub. The trip arm is fastened to the pulley such that the trip arm co-rotates with the pulley but is allowed radial movement relative to the pulley. The drive hub further including a track having an inner track portion, an outer track portion and a cam portion. The trip arm includes a cam follower end disposed in the track and a trip end opposite the cam follower end wherein relative rotation between the drive hub and the pulley moves the cam follower end within the track such that in a first direction of wash basket rotation the cam follower end is positioned in the inner track such that the trip end is disposed radially inwardly of the outer diameter of the pulley and in a second direction of wash basket rotation the cam follower end is positioned in the outer track such that the trip end is disposed radially beyond the outer diameter of the pulley.

The present invention is further directed to an automatic washer having an imperforate tub, a horizontal axis wash basket disposed within the tub wherein a motor is drivingly connected with the wash basket for selectively rotating the wash basket about the horizontal axis. A control shaft is rotatably supported by the tub and includes a main portion disposed adjacent the basket and an end extending external of the tub. A plurality of elements are interconnected with the control shaft for rotation therewith for controlling the operation of the washer and a spring is provided for biasing the control shaft to rotate such that the plurality of elements are urged toward the basket. A hub is rigidly attached to the externally extending end of the control shaft and is adapted for selectively controlling the angular position of the control shaft relative to the tub. A latching mechanism is disposed adjacent the hub for latching the hub in a predetermined angular position against the rotational bias of the control shaft. A pulley system is provided for selectively tripping the latching mechanism such that the hub is selectively released such that the control shaft rotates under the urgings of the spring.

BRIEF DESCRIPTION OF THE DRAWINGS

FIG. 9 is an enlarged side elevational view taken along lines IX—IX in FIG. 5, showing the latching mechanism of the present invention.

FIG. 10 is a sectional view taken along line X—X in FIG. 9.

DESCRIPTION OF PREFERRED EMBODIMENT

Figure 1:
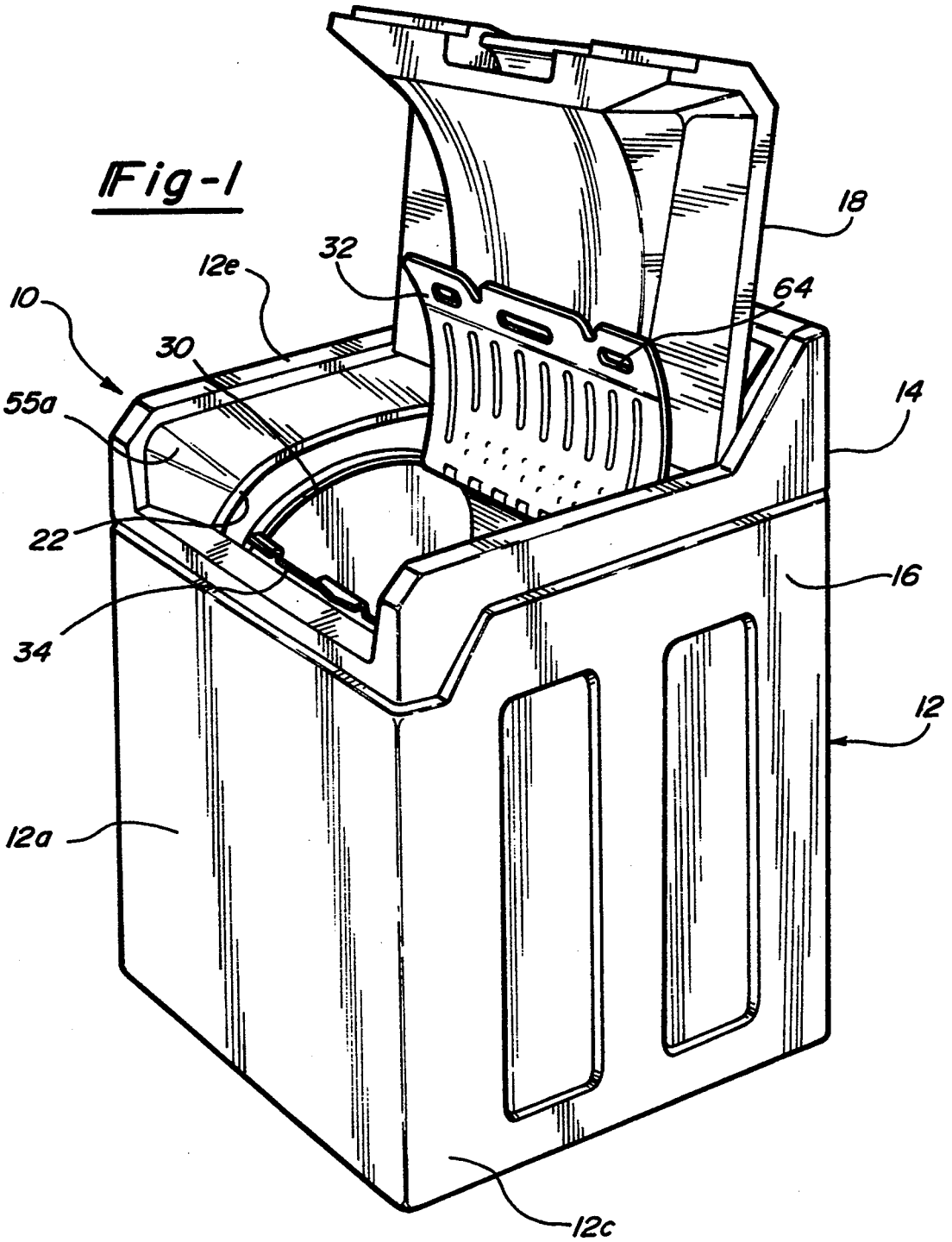
FIG. 1 is a top, front and side perspective view of the automatic washer embodying the present invention having the lid and basket door flaps shown in the open position.
Figure 2:
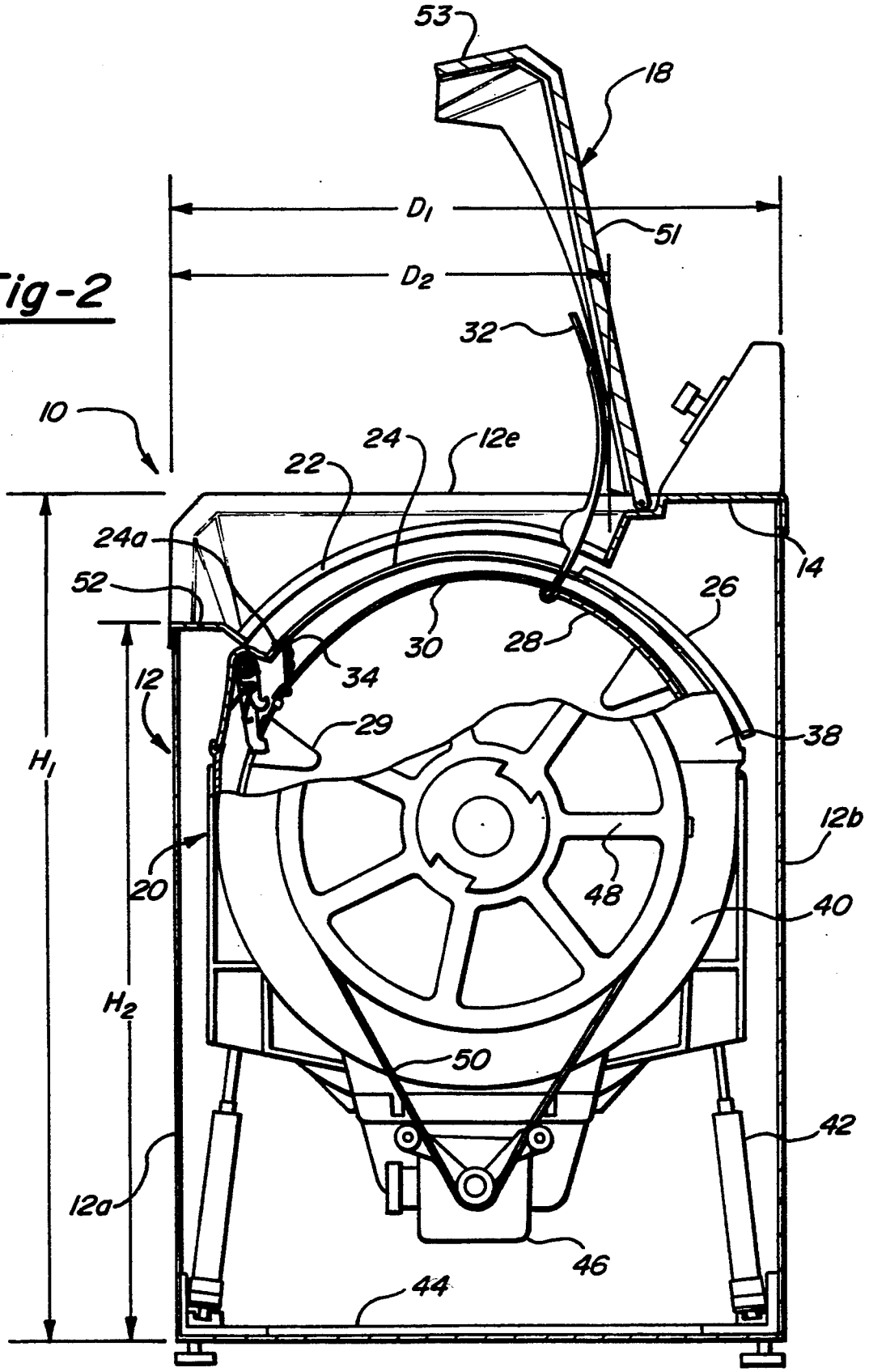
FIG. 2 is a partially cutaway side elevational view of the automatic washer of FIG. 1.

In FIGS. 1 and 2, there is illustrated a top-loading drum-type automatic washer 10 embodying the principles of the present invention. The washer 10 has an enclosure 12 generally defining a front surface 12*a*, a back surface 12*b*, opposite side surfaces 12*c* and 12*d* and a top surface 12*e*. The enclosure includes a top member 14, an outer cabinet 16 and an openable lid 18, shown in an open position, which encloses an imperforate wash tub 20. The top member 14 includes an access opening 22 extending partially along the top surface 12*e* and the front surface 12*a* for accessing the interior of the enclosure 12. The wash tub 20 has an upwardly orientated rectangular tub opening 24 having a front edge 24*a*. The opening 24 is aligned with the access opening 22 and a slidable wash tub lid 26, shown in an open position, is provided for sealably closing the opening 24.

Disposed within the wash tub 20 is a rotatable, perforate wash basket 28 having a rectangular basket opening 30 provided with an openable first door flap 32 and an openable second door flap 34. Each door flap includes a free edge portion 32*a* and 34*a*, respectively. The door flaps 32 34, shown in an open position, may be aligned with the tub opening 24 for allowing access into the wash basket 28 such that clothes may be loaded and unloaded from the wash basket 28. A plurality of baffles 29 may be disposed within the basket 28, attached to the inner surface of the basket 28 and extending inwardly for enhancing the tumbling action of the clothes items within the basket 28 during a wash cycle.

The general construction of the rotatable basket 28 and balancing disks 36 (FIG. 5) are shown and described in pending U.S. patent application Ser. No. 07/997,435, Farrington et al., the specification of which is herein incorporated by reference. The wash tub 20 is formed by a two piece construction including an upper tub member 38 and a lower tub member 40. The tub 20 is supported within the enclosure 12 by struts 42 extending from the lower tub member 40 to a frame 44. A motor 46 is supported from the lower tub member 40 and is drivably connected to a pulley 48 by a belt 50. The pulley 48 is drivably interconnected with the basket 28 such that the motor 46 may rotate the basket 28 within the tub.

The automatic washer 10 is configured to ease loading and unloading of clothes items into the wash basket 28. As described above, the access opening 22 is configured to extend partially along the top surface 12*e* and front surface 12*a* such that clothes items being loaded and unloaded from the wash basket 28 must be raised only to the height of a front lip portion 52 of the top member 14 to pass through the access opening 22. The ratio of the overall height H1 of the enclosure 12 to the distance H2 from the bottom of the enclosure 12 to the front lip portion 52, when measured in like units, is approximately 1.16. Further, the access opening 22 extends along the top surface 12*e* such that the ratio of the overall depth D1 of the automatic washer 10 to the overall length D2 of the access opening 22 is 1.4. It can be seen, therefore, that access opening 22 provides a relatively large front angled opening for accessing the interior of the wash basket 28.

The lid 18 is configured to completely cover the access opening 22. The lid therefore includes a first portion 51 extending along the top surface 12*e* and a second portion 53 extending along front surface 12*a*.

The top member 14 includes downwardly sloped side interior walls 55*a* and 55*b* which are disposed along the side edges of the access opening 22. These side interior walls extend from the top surface 12*e* to the edge of the access opening 22 for providing a funnelling effect such that clothes being loaded into the wash basket 28 are downwardly directed under the urgings of gravity along the side interior walls 55*a* and 55*b* into the wash basket 28.

Figure 3:
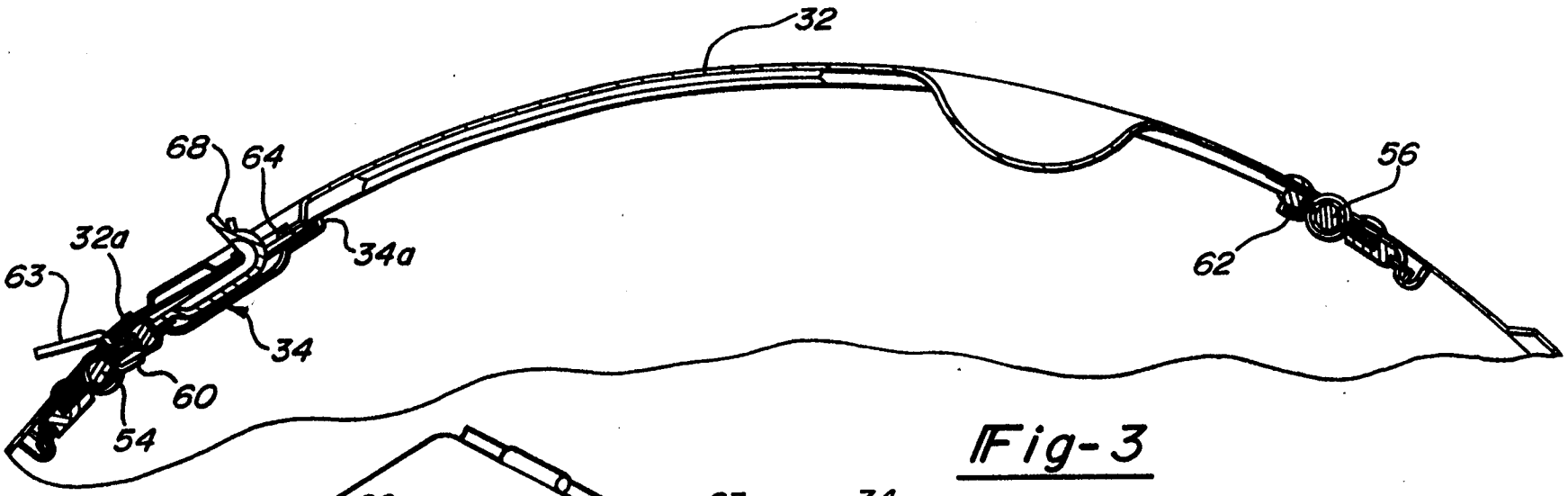
FIG. 3 is a sectional view of the door flaps of the wash basket with the door flaps partially disengaged.

The door flaps 32 and 34 are configured to further enhance operator access into the wash basket 28. As best seen in FIGS. 2 and 3, the first door flap 32 is relatively large, having an arc length approximately equal to size of the basket opening 30. The second door flap 34 is relatively small in comparison to the first door flap 32. As contemplated by the inventors, the first door flap 32 has an arc length of approximately 13" and the second door flap 34 has an arc length of approximately 3". The door flaps are hinged at mutually opposite edges 30*a* and 30*b* of the rectangular opening 30 and are partially overlapped when they are closed. The door flaps 32 and 34 are curved throughout their width in such a way that, when they are in their closure position, the outline of the flaps 32 and 34 does not project beyond the circular outline of the basket. At respective hinge points 54 and 56, the door flaps 32 and 34 are also provided with a least one respective torsion spring 60 and 62 for urging their respective door flaps upwardly into its open position. Extending from the second door flap 34 is a tab 63 for limiting the rotation of the second door flap 34 about the hinge point 54.

When the basket opening 30 is correctly aligned with the tub opening 24, the door flaps may be opened for allowing access through the opening 30 into the interior of the basket 28. When the flaps 32 and 34 are opened, the second door flap 34 is urged upwardly and is positioned adjacent the front edge 24*a* of the tub opening 24. The tab 63 limits the rotational travel of the second door flap 34 and positions the second door flap 34 partially closed at a predetermined angle relative to a tangential line to the basket 28 having the hinge point 54 as a tangent point. The predetermined angle is preferably approximately 45°. The first door flap 34 is also urged upwardly when opened and is rotationally limited and positioned against the lid 18. It can be seen, therefore, that the asymmetrical configuration of the door flaps is such that the door flaps 32 and 34, when opened, do not hinder access into the interior of the wash basket 28. Specifically, the second door flap 34 extends just beyond the front edge 24*a* but does not interfere with loading and unloading clothes due to its small size while the much larger second door flap is positioned against the lid 18 out of the path of loading and unloading clothes items into the wash basket 28.

Closure of the door flaps 32 and 34 is achieved by downwardly forcing the open first door flap 32. The resultant downward rotation of the first door flap causes the free edge 32*a* of the first door flap 32 to catch the free edge 34*a* of the second door flap 34. This is possible due to the fixed angle, partially closed position in which the second door flap 34 is held by tab 63 when in its open position, which positions the free edge 34*a* of the second door flap 34 in the arc traced by the free edge 32*a* of the first door flap 32 when the first door flap 32 is moved from an open position to a closed position. In this fashion, both of the door flaps 32 and 34 may be engaged by only downwardly urging the first door flap 32.

Figure 4:
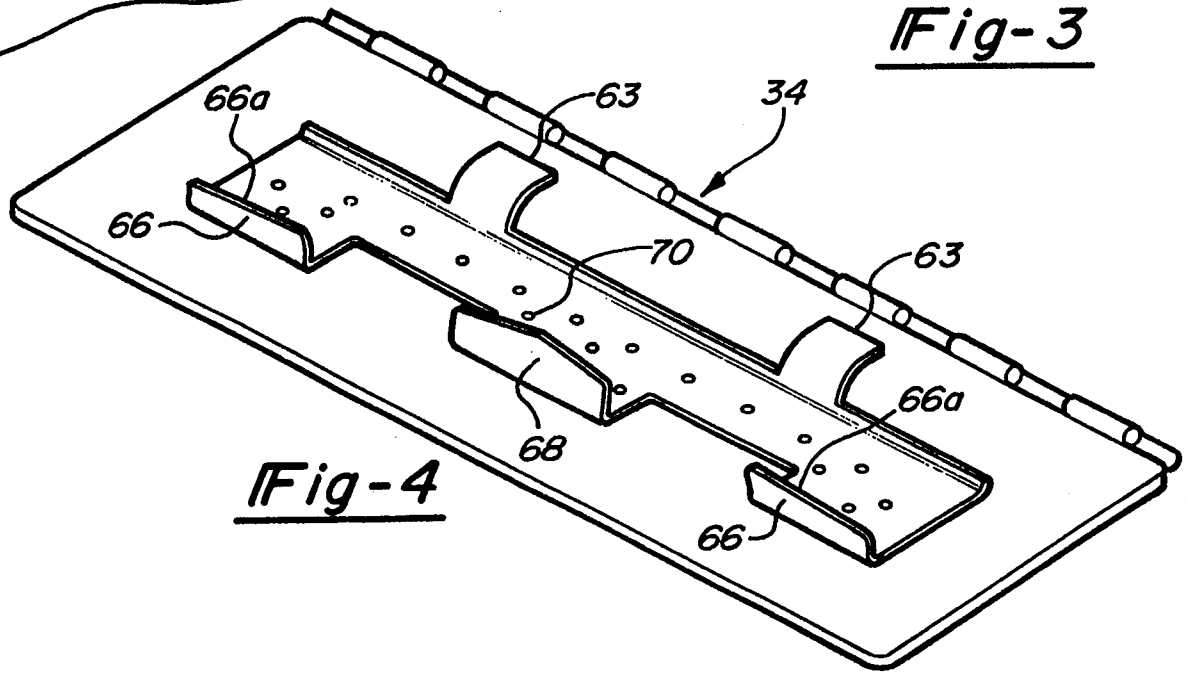
FIG. 4 is a top, front and side perspective view of the second door flap of the present invention.

As shown in FIGS. 3 and 4, apertures 64, side hook members 66 and center hook member 68 are respectively provided along the free edges 32*a* and 34*a* of the door flaps in such a position as to permit the apertures 64 and hook members 66 and 68 to engage each other when the first door flap 32 is pushed downwardly. The hook members are configured to provide a highly reliable latching system for the door flaps 32 and 34 wherein all of the hook members properly engage their respective apertures. It can be seen that the hook members 66 and 68 have been tapered from a center point 70 such that the center hook 68 is the tallest hook member and has a vee shaped contact point. In this fashion, the center hook 68 is the first hook to engage its respective aperture even if the first door flap is twisted or forced downwardly with an off-center force. The side hooks 66 are configured having a s-curved shape wherein the top edges 66a of the side hooks are bent forward, away from premature contact and engagement with the matching first door flap piece. With the s-curve shape, the side hooks 66 are further prevented from latching prior to the center hook 68.

The above described door flap and basket construction allows for a relatively large diameter wash basket 28 in comparison to the overall height of the washer 10. Typically, in order to prevent the door flaps of a top loading horizontal washer from interfering with basket access, a lengthy tub access conduit is provided, extending from the top surface of the washer to the basket opening. However, due to the above described structure, in the present invention the basket opening 30 can approach the top surface 12*e* of the washer 10 such that the basket opening 30 is positioned relatively close to the top surface 12*e* of the washer. This allows the basket diameter to be relatively large in comparison to the overall height of the washer 10. As contemplated by the inventors, the ratio of overall height H1 of the enclosure 12 to the diameter of the basket 28, when measured in like units, is approximately 1.7.

Figure 5:
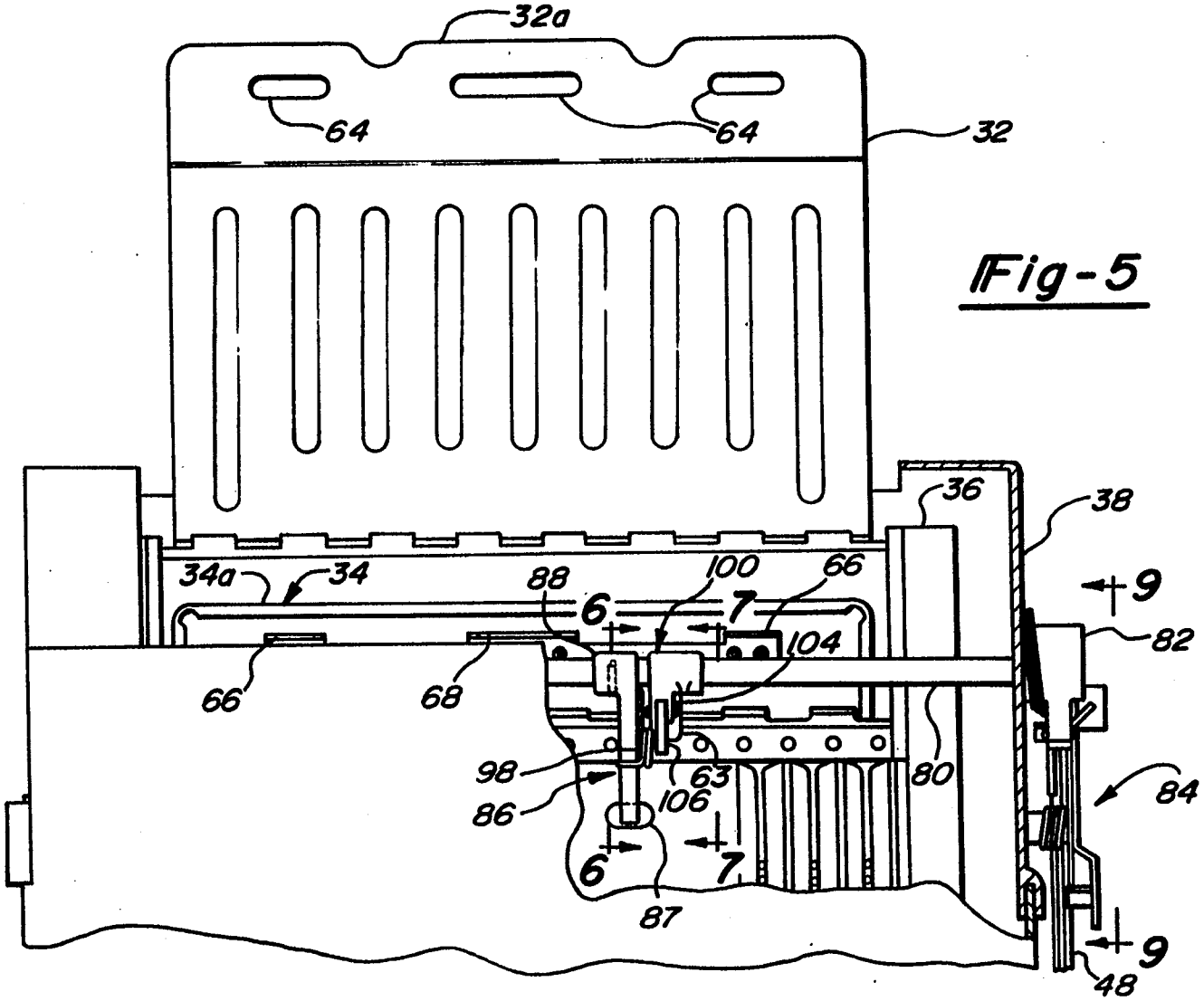
FIG. 5 is a partially cut away front elevational view of the wash tub and wash basket of the present invention.
Figure 6:
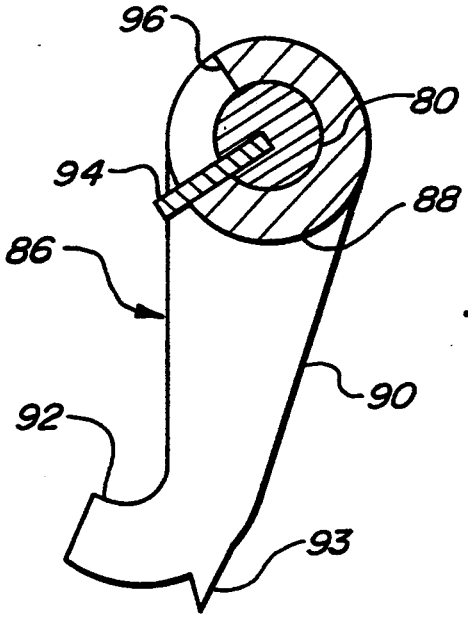
FIG. 6 is a sectional view taken along lines VI—VI in FIG. 5.
Figure 7:
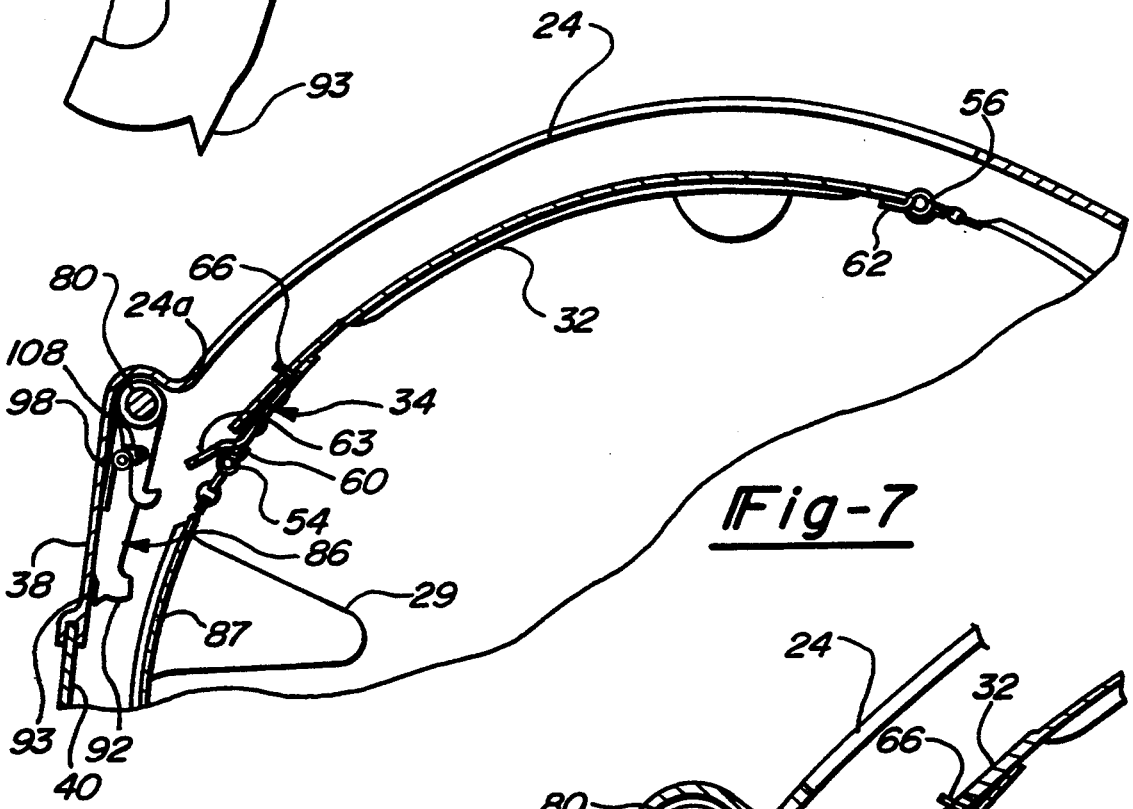
FIG. 7 is a sectional view of the door flaps, wash basket and tub of the present invention with the door flaps in their engaged position.

Turning now to FIGS. 5–7, a control shaft 80 is shown supported within the tub 20 and disposed adjacent the rotatable basket 28. The control shaft 80 is rotatably supported at opposite ends by the upper tub member 38 and includes at least one end extending through the upper tub member 38 wherein a rotary positioning member or rotary positioning hub 82 is secured to the control shaft 80 outside the upper tub member 38. A latching mechanism 84 is provided adjacent the hub 82 for latching the hub 82 in a predetermined position, as described in detail herein further below. The hub 82, latching mechanism 84 and pulley 48 are shown disposed on the right hand side of the tub 20 but could be disposed on the opposite side and function in an identical fashion, as can be understood by one skilled in the art. The below description makes frequent reference to rotational directions by using the terms "clockwise" and "counter-clockwise". It can be understood by those skilled in the art that these terms are used with respect to a right side view perspective as illustrated in FIGS. 7, 9, 11, and 14–17.

The control shaft 80 supports a holding arm 86 adjacent the rotatable basket 28 which may be controlled for engaging a stop opening 87 provided in the wash basket 28 for positioning the basket 28 during loading and unloading. As shown, one of the baffles 29 may be preferably positioned over the stop opening 87. As best shown in FIG. 6, the holding arm 86 includes a boss portion 88 surrounding the control shaft 80 and a leg portion 90 having a hook-like catch portion 92 provided at the end of the leg portion 90. An engagement finger 93 is provided extending from the catch portion 92 for limiting engagement of the holding arm 86 with the basket stop opening 87. A pin 94, extending from the control shaft 80, engages a slot 96 provided on the boss 88 of the holding arm 86 for controlling relative rotation of the holding arm 86 about the control shaft 80. In this fashion the control shaft 80 may rotate within the holding arm boss portion 88 while the holding arm 86 remains angularly fixed. A torsion spring 98 is provided for urging the holding arm 86 toward the basket 28 in a counter-clockwise direction.

A tab engagement arm 100 is also supported by the control shaft 80 adjacent the basket 28 which may be controlled for engaging the tab 63 extending from the second door flap 34 wherein the door flaps 32 and 34 may be released from a closed position to an open position. As seen in FIGS. 5 and 7, the tab engagement arm 100 includes a drive arm member 104 which is rigidly secured to the control shaft 80 for rotation therewith, and a tab hook 106 being hingedly mounted at the end of the drive arm 104. A spring 108 is provided for biasing the tab hook 106 toward the basket 28 wherein the tab hook 106 is positioned by the hinged connection and the spring 108 to extend straight from the drive arm 104 radially away from the center of the drive shaft 80.

Figure 8:
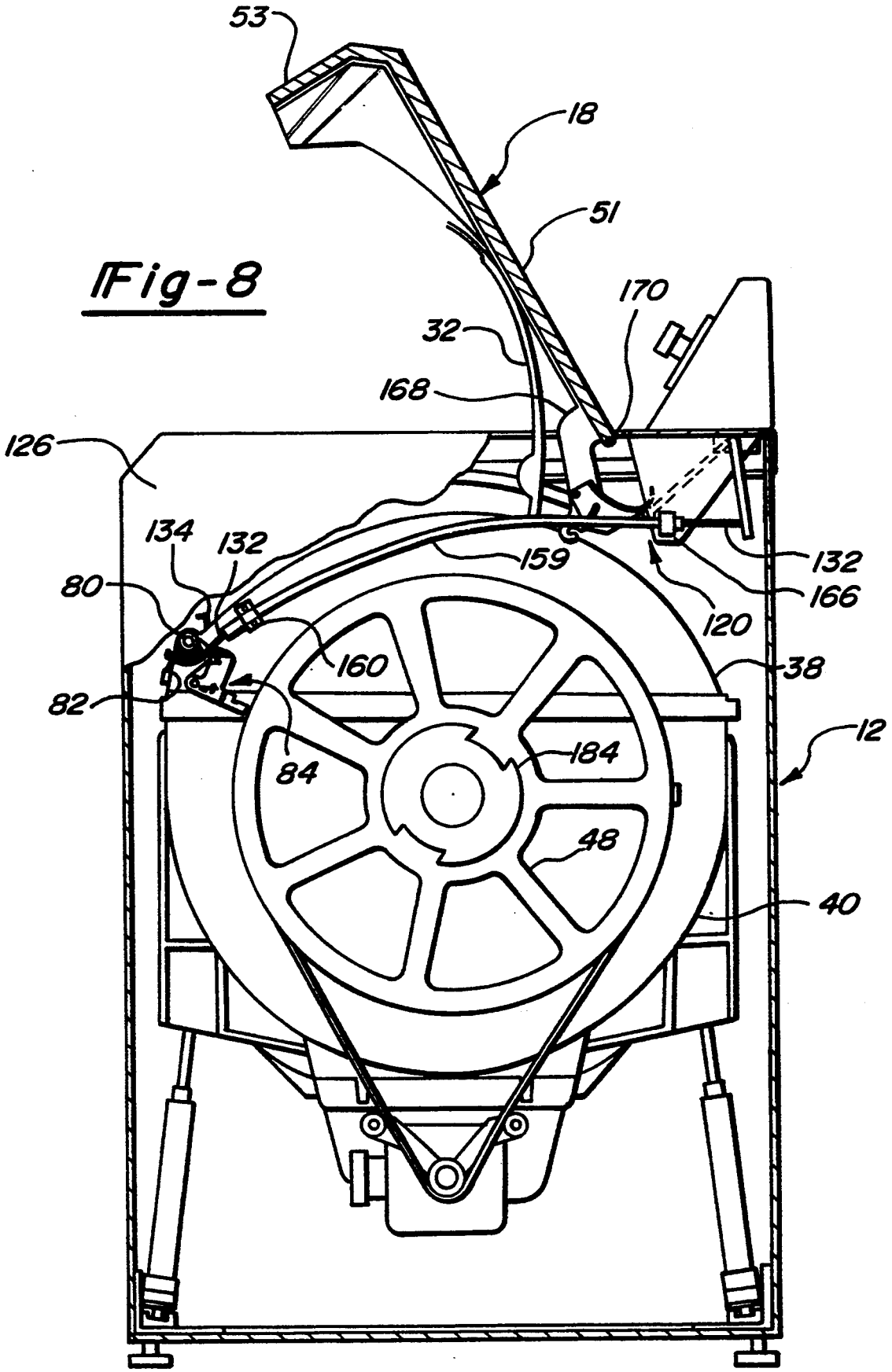
FIG. 8 is a partially cut away side elevational view of the automatic washer of FIG. 1.
Figure 11:
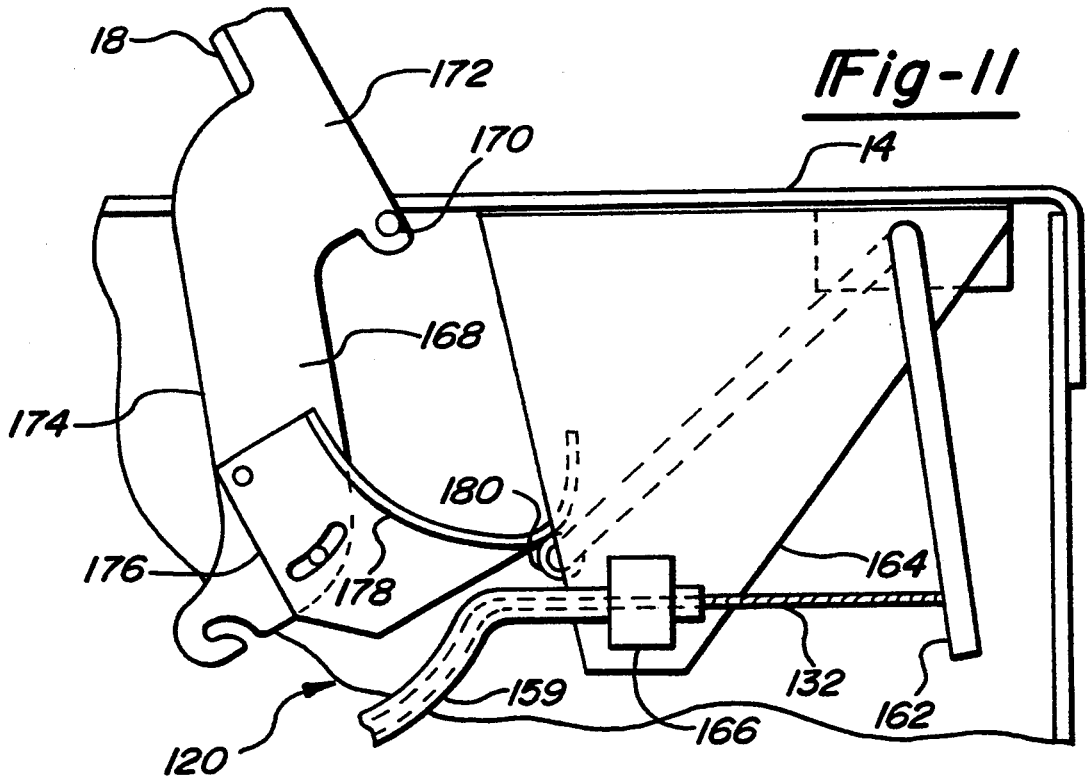
FIG. 11 is an enlarged side elevational view showing the lid mechanism of the present invention.

Turning now to FIG. 8, the hub 82 attached to the control shaft 80 is shown along with the latching mechanism 84 and a lid mechanism 120. These systems operate to control the rotation of the control shaft 80 to actuate the holding arm 86 and the tab engagement arm 100 for positioning the basket 28 and opening the door flaps 32 and 34, as will be described herein below.

In FIGS. 9 and 10, the hub 82 is shown in detail, held in its engaged position by the latching mechanism 84. The hub 82 is preferably a thermoplastic member and is secured to the control shaft 80 by a screw 123. A torsion spring 124 is provided for urging the hub 82 to rotate clockwise as shown. The torque applied to the control shaft 80 by spring 124 is less than the torque applied to the shaft by spring 98. The hub 82 is generally fan shaped and includes a notch 126 and an outer surface 127. A hook portion 128 is provided along with a cable guide surface 130 such that a cable 132, extending from the lid mechanism 120, may be secured to the hub 82. A hub switch 234 is secured to the upper tub 38 adjacent the hub 82 for sensing rotation of the hub. In particular, the orientation of the hub switch 234 is such that rotation of the hub 82 corresponding to engagement of the holding arm 86 into the stop opening 87 is sensed.

The latching mechanism 84 includes a latching lever 134 and a tripping lever 136. These levers are contemplated to be metallic and formed by a sheet steel stamping operation. The levers 134 and 136 are disposed adjacent to each other and are rotatably secured to the upper tub member 38 by a shaft 138 having a threaded retaining end 140. The latching lever 134 is provided with a catch flange 142 for engaging the notch 126 provided on the hub 82. A torsion spring 144 is provided for urging the latching lever 134 toward the hub 82. The latching lever 134 is further provided with a tab 145 which extends from the lever 134 outwardly through a slot 146 provided in the tripping lever 136. In this fashion, the levers 134 and 136 are free to rotate a small angular distance relative to each other. A spring 149 is provided for urging the latching lever 134 counter-clockwise toward the hub 82 relative to the tripping lever 136.

The tripping lever 136 is provided with a first arm portion 147 extending toward the pulley 48 and a second arm portion 148. The second arm portion 148 is provided with a flange portion 150 having a hole 152. A connecting rod 154 interconnected with the hub 82 extends through the hole 152 of the flange 150. A spring 156 is positioned between the flange 150 and a collar 158 provided on the rod 154, such that the hub 82 and tripping lever 136 are resiliently interconnected with each other.

As mentioned above and shown in FIGS. 8 and 11, the lid mechanism 120 may operate to control the rotation of the control shaft 80 when the basket 28 is positioned and the holding arm 86 is in the stop opening 87. The lid mechanism 120 is interconnected directly to the hub 82 by the cable 132 which may be enclosed in a casing 159 wherein the casing 159 is secured to the upper tub 38 by bracket 160. The cable 132 is attached to a cam follower lever 162, at the end opposite attachment to the hub 82. The cam follower lever 162 is rotatably supported by a cam bracket 164 which is secured to the top 14 and which also provides a surface for attaching a bracket 166 which slidably supports the cable 132.

Extending from lid 18 is a lid hinge 168 which hingedly connects the lid 18 with the top 14 at hinge point 170. The lid hinge 168 includes a first portion 172 secured to the lid 18 and a second portion 174 extending beyond the hinge point 170 which supports a lid hinge cam 176. The lid hinge cam 176 includes a cam surface 178 which slidably engages a cam follower end 180 of the cam follower lever 162. The cam surface 178 is configured such that moving the lid from a closed position to an open position causes the cam surface to engage the cam follower end 180 such that the cable 132 is moved from a first rest position to a second forward position and back to the first rest position.

Figure 12:
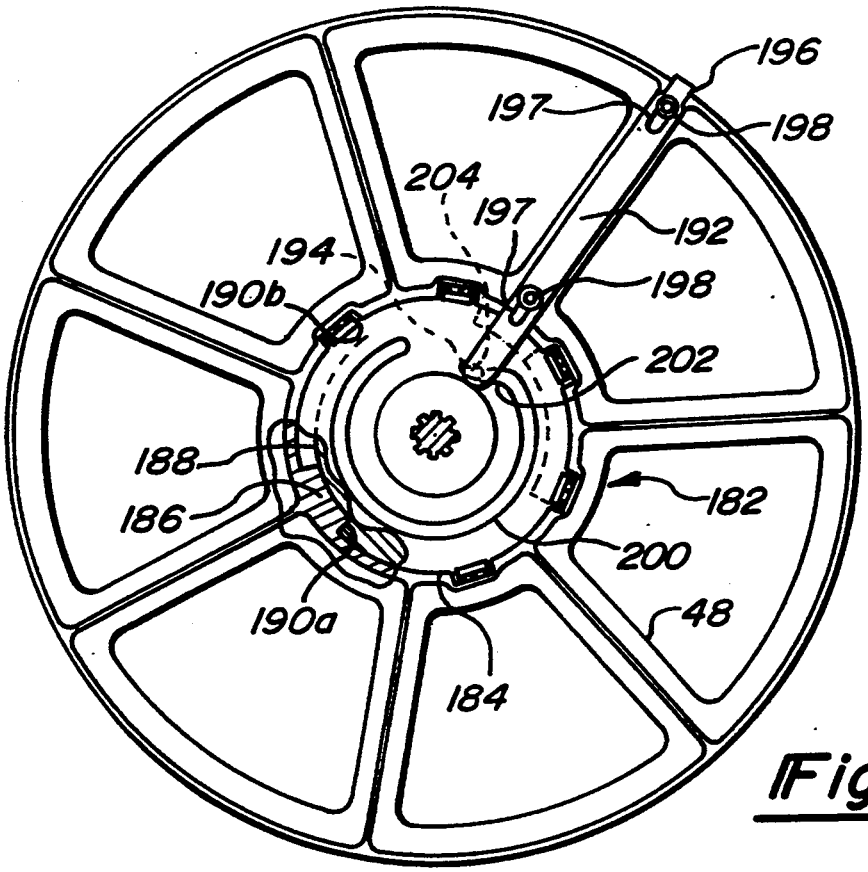
FIG. 12 is a side sectional view showing the inner face of the pulley and the tripping mechanism of the present invention wherein the tripping mechanism is in a disengaged position.
Figure 13:
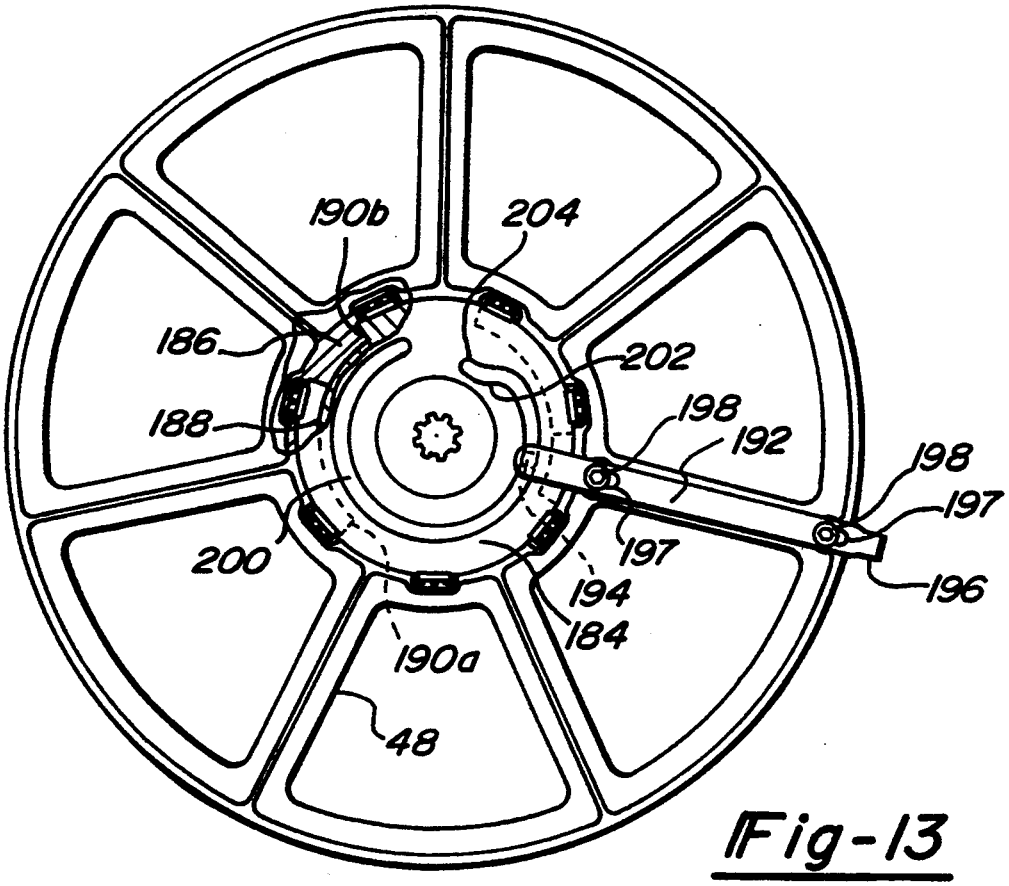
FIG. 13 is a side sectional view showing the inner face of the pulley and the tripping mechanism of the present invention wherein the tripping mechanism is in an engaged position.

In FIGS. 12 and 13, the inward face of the pulley is shown including a tripping mechanism 182. The tripping mechanism 182 is associated with the pulley 48 and operates to trip the latching mechanism 84 and to reset the latching mechanism 84. The tripping mechanism 182 is designed such that during normal clockwise rotation of the pulley 48, no engagement with the latching mechanism occurs. However, when access to the basket 28 is desired, rotation of the pulley 48 is reversed to a counter-clockwise rotation wherein the tripping mechanism 182 engages the latching mechanism 84 so that the holding arm 86 is released to engage the stop opening 87 for positioning the basket 28. When the rotation of the basket 28 is desired to be resumed, the tripping mechanism 122 operates to again engage the latching mechanism 84 to reset it, drawing the holding arm 86 away from the basket 28.

Pulley rotation is required for causing the tripping mechanism 182 to trip and reset the latching mechanism 84. However, it can be understood that until the latching mechanism 84 is reset, drawing the holding arm 86 out of the stop opening 87 of the basket 28, the basket 28 can not rotate. Therefore, a two piece pulley system is required which provides for lost motion of the basket 28 while the pulley 48 rotates to resent the latching mechanism 84.

The pulley 48, therefore, is slidingly disposed about a drive hub 184 which is rigidly attached to a basket drive shaft 185 for driving the basket 28. The pulley 48 is supported by the drive hub 184 in such a manner that limited relative rotation between the drive hub 184 and the pulley 48 may occur. To accomplish this limited relative rotation, the pulley 48 is provided with a inwardly extending drive dog 186 which rides within a slot 188 provided on the outer diameter of the drive hub 184. End walls **190*a* and 190*b* are provided in the slot 188 for interfering with the movement of the drive dog 186 within the slot 188 such that the pulley 48 may rotate a limited angular distance relative to the drive hub 184 and then engage the hub for co-rotation. It is contemplated by the inventors that the pulley 48 and drive hub 184** may be constructed of different types of plastic material and slidingly engage each other along their inner and outer periphery, respectively.

The tripping mechanism 182 further includes a trip arm 192 having a cam follower end 194 and a trip end 196. The trip arm 192 includes slots 197 through which shouldered fasteners 198 are placed for securing the trip arm 192 to the pulley 48 for allowing axial movement of the trip arm 192 relative to the pulley 48. The cam follower end 194 is positioned in a track 200 provided in the drive hub 184. The track 200 includes a cam portion 202 and and inner track 204.

Remembering that FIG. 12 and FIG. 13 illustrate the internal or inward face of the pulley 48 and therefore rotational directions appear to be reversed, it can be seen in FIG. 12, that when the pulley 48 is driven in a clockwise direction for driving the basket 28, the pulley 48 rotates around the drive hub 184 until the drive dog 186 is driven into the end wall **190*a*. This rotation of the pulley 48 around the drive hub 184 positions the cam follower end 194 within the inner track 204 wherein the trip end 196 is positioned in a first position such that the trip end 196 does not engage the latching mechanism 84 during the basket/pulley co-rotation. However, as shown in FIG. 13, when the direction of the pulley rotation is changed such that the pulley 48 is driven in a counter-clockwise rotation, the pulley 48 rotates about the hub 196 until the drive dog 186 is driven into the end wall 190*b*. This rotation of the pulley 48 around the drive hub 184 positions the cam follower end 194 within the track 200 wherein the trip end 196 is positioned in a second position having the trip end 196 positioned radially outward for engaging the latching mechanism when the trip end 196 is rotated past the latching mechanism 84**.

Figure 14:
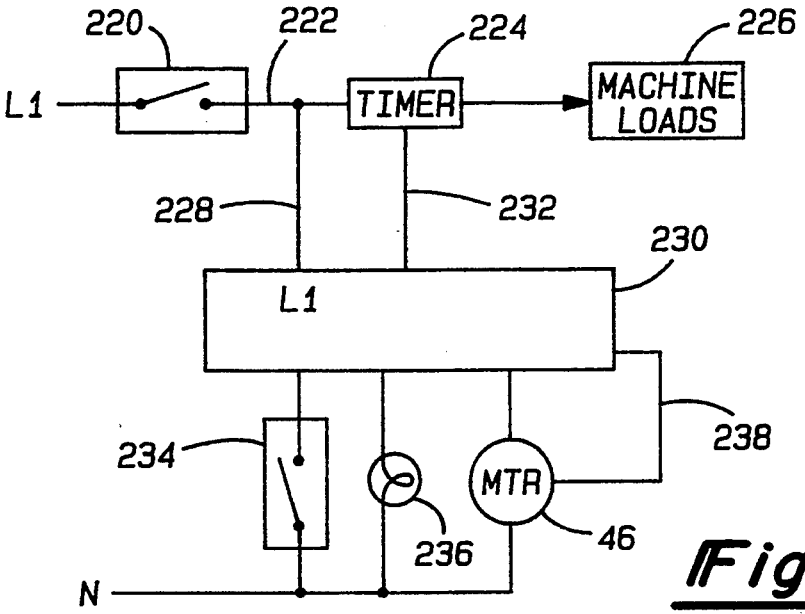
FIG. 14 is a circuit diagram for the automatic washer of FIG. 8.

FIG. 14 illustrates a simple circuit diagram for the above described automatic washer 10. A lid switch 220 is provided associated with the lid 18 for breaking the power supply to the automatic washer upon opening the lid 18. Line 222 connects the lid switch 220 with a timer 224 for controlling the operation of various components of the washer. The timer 224 includes a plurality of switches for controlling a plurality of machine loads 226, as is known. A line 228 extends from line 222 to a printed circuit board (PCB) or control board 230, including a microprocessor. Additionally, a line 232 extends from the timer to the control board 230.

As is known to one skilled in the art, the timer 224 contains a line switch (not shown) for energizing the timer such that closing the line switch energizes the timer and opening the line switch deenergizes the timer. Frequently, the timer line switch may be operated by the user by pushing/pulling on the timer knob. Once the timer is energized by closing the timer line switch, line 232 provides a 110 v signal input to the printed circuit board 230, which is energized through line 228. The control board 230 further receives a signal input from the hub switch 234 and selectively energizes an indicator light 236 and the motor 46. The motor may be a 220 v. DC variable speed universal motor. A tachometer feed-back line 238 provides a motor speed sensitive signal back to the control board 230. Included in the control board 230 is a reversing relay for operating the motor 46 in either a clockwise or counter-clockwise direction.

Figure 17:
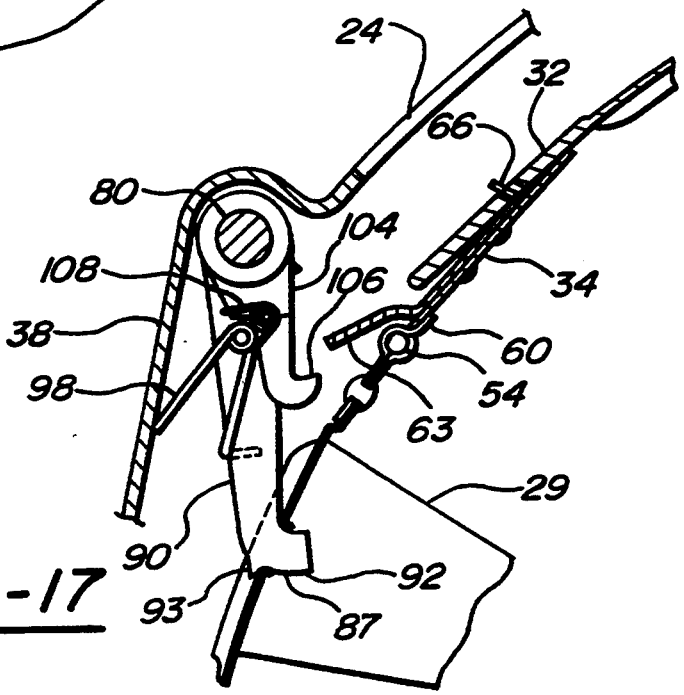
FIG. 17 is an enlarged sectional view showing the holding arm, hook assembly and door flaps of the present invention.
Figure 16:
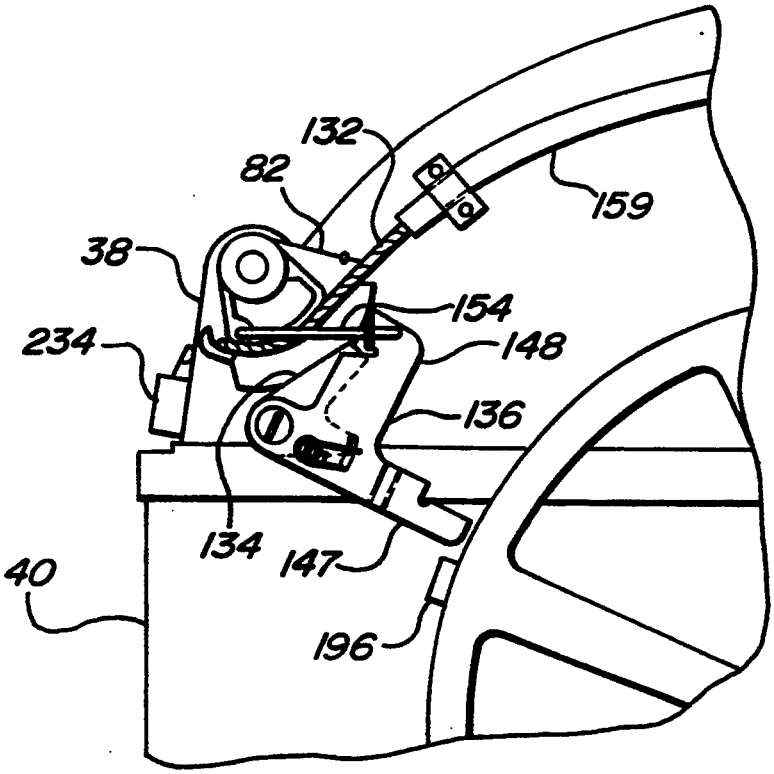
FIG. 16 is an enlarged partial side view of the tub of the present invention showing the cam in a disengaged position.
Figure 15:
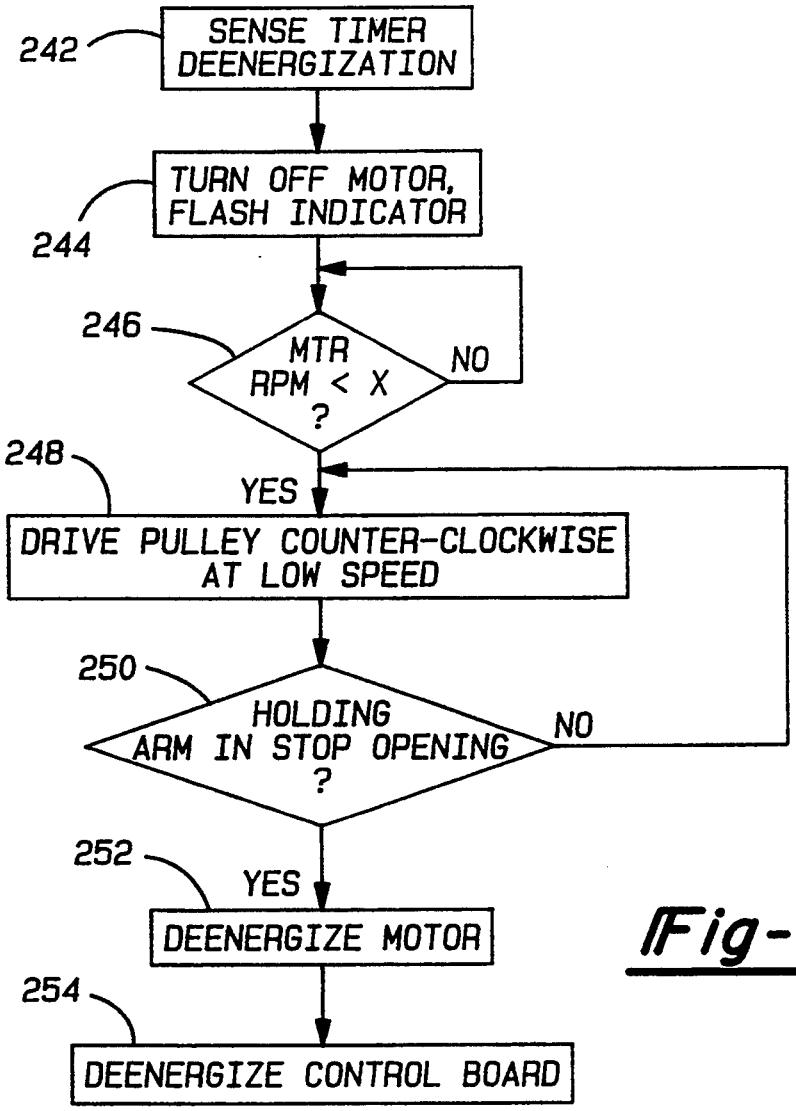
FIG. 15 is a flow chart illustrating the steps implemented by the control system of the washing machine of FIG. 8 to carry out a method of positioning the wash basket according to the present invention.

Turning now to FIGS. 15–17, the operation of the latching mechanisms 84, the lid mechanism 120, and the tripping mechanism 182 for causing rotation of the control shaft 80 may be shown. These mechanisms operate to automatically position and hold the basket 28 in its load/unload position as well as automatically opening the basket doors 32 and 34 when the lid 18 is opened. These operations, moreover, require only a basic control system as illustrated in FIG. 15.

During washer operation, the basket 28 must be free to to rotate within the tub 20 requiring that the holding arm 86 and tab engagement arm 100 be held in a disengaged position, away from the basket 28, as illustrated in FIG. 7. Corresponding to the disengaged position of the holding arm 86 and tab engagement arm 100, the hub 82 and control shaft 80 are held in a predetermined angular position, shown in FIG. 9, which may be termed angular position "A". It may be understood, therefore, that when the control shaft is held in the angular position "A", the holding arm 86 and the tab engagement arm 100 are positioned away from the basket 28 such that the basket 28 is free to rotate. The hub 82, is held, against the counter-clockwise rotational urgings of the spring 98, in its respective position by the engagement of the latching lever 134 with the notch 126 on the hub 82.

Wash basket auto-positioning and holding is initiated when the timer 224 is deenergized, as shown in step 242 of FIG. 15. Timer deenergization occurs automatically at the conclusion of a completed wash cycle and may also occur as a result of operator wash cycle interruption. In both cases, the timer line switch is opened, deenergizing the timer, which is sensed by the control board 230 through signal input line 232, as shown in step 242. In step 244, subsequent to the timer deenergization, the motor is deenergized and the indicator light 236 is flashed to signal to the user that the basket is being automatically positioned. Motor speed is sensed in step 246, determining when basket rotation has stopped or is less than a predetermined value. This basket "coast down" time may vary based on the wash load size and balance within the basket 28 and whether the basket 28 was in a high speed spin or low speed tumble. Motor speed sensing may be replaced by a simple hold time, long enough to ensure that basket rotation has slowed or stopped. Once the rotation of the basket 28 in a clockwise direction has slowed sufficiently or stopped, the pulley 48 is driven in a counter-clockwise direction by the motor 46, as shown in step 248.

As described above, driving the pulley 48 in a counter-clockwise direction causes the trip end 196 of the tripping mechanism 182 to move to the second position, shown in FIG. 13, for engaging the first arm portion 147 of the tripping lever 136. As shown in FIG. 16, when the radially extended trip end 196 is rotated past the first arm portion 147, the trip end 196 engages the first arm portion 147 and causes the tripping lever 136 to rotate in a clock-wise direction about the shaft 138. The latching lever 134 rotates with the tripping lever 136 as a result of the engagement created by the tab 145 extending through the slot 146. The rotation of the latching lever pulls the catch flange 142 off of the notch 126 such that the hub 82 is disengaged from the latching lever 134 wherein, under the urgings of the spring 98, the hub 82 and the control shaft 80 rotate in a counter-clockwise direction.

As a result of this counter-clockwise rotation of the control shaft 80, the holding arm 86 is urged into the rotating basket 28. As shown in FIG. 17, engagement between the basket 28 and the holding arm 86 occurs upon alignment of the catch portion 92 of the holding arm 86 with the stop opening 87 in the basket 28. This position of the control shaft 80 maybe called angular position "B".

In step 250, holding arm engagement into the stop opening 87 is sensed by the hub switch 234. Alternately, holding arm engagement may be determined by sensing a locked rotor condition of the motor 46. Upon sensing that the holding arm 86 has engaged with the stop opening 87, the motor 46 is deenergized, as shown in step 252. Finally, in step 254, the control board 230 is deenergized which simultaneously deenergizes the flashing indicator light 236.

It can be understood, therefore, that simple rotation of the pulley 48 and the basket 28 in a reverse direction from the direction of rotation during the wash cycle, operates to secure the basket 28 in the desired position for loading and unloading clothes items. The use of the the trip arm 192 for releasing the latching mechanism 84 thereby actuating the holding arm 86 ensures that the holding arm 86 is driven into the rotating basket 28 just prior to alignment between the catch portion 92 with the stop opening 87. In this fashion, the holding arm 86 does not drag across a large portion of the outer circumference of the basket 28, which may result in undue holding arm wear, undue noise and possible misoperation. It can be seen, therefore, that the present invention provides a system requiring only a very basic control system for automatically positioning the basket 28 for loading and unloading clothes items.

Figure 18:
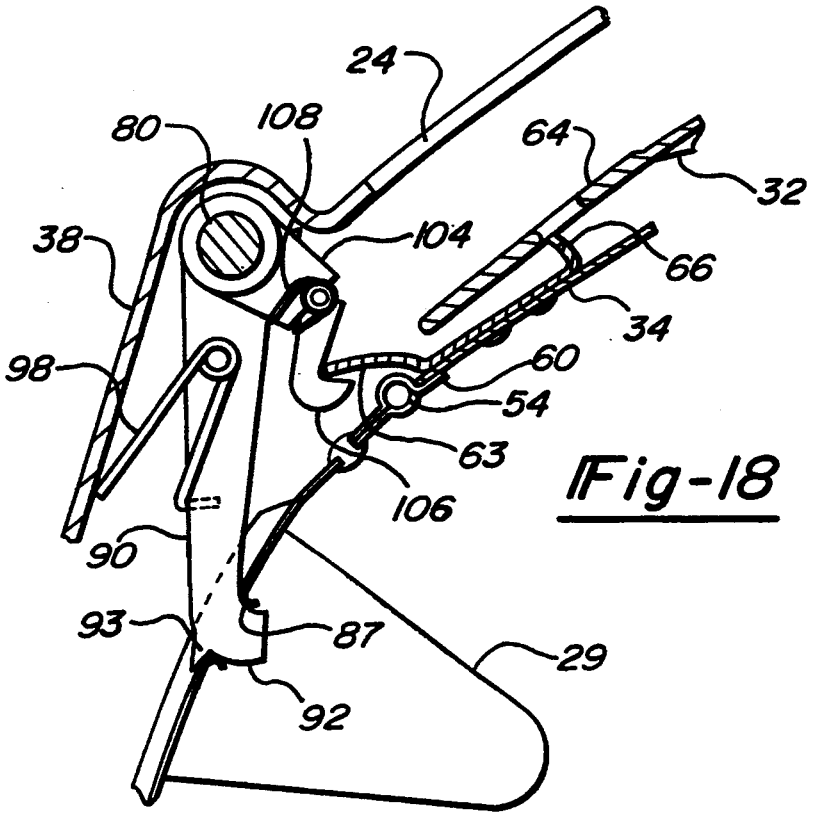
FIG. 18 is an enlarged sectional view showing the holding arm, hook assembly and door flaps of the present invention.
Figure 19:
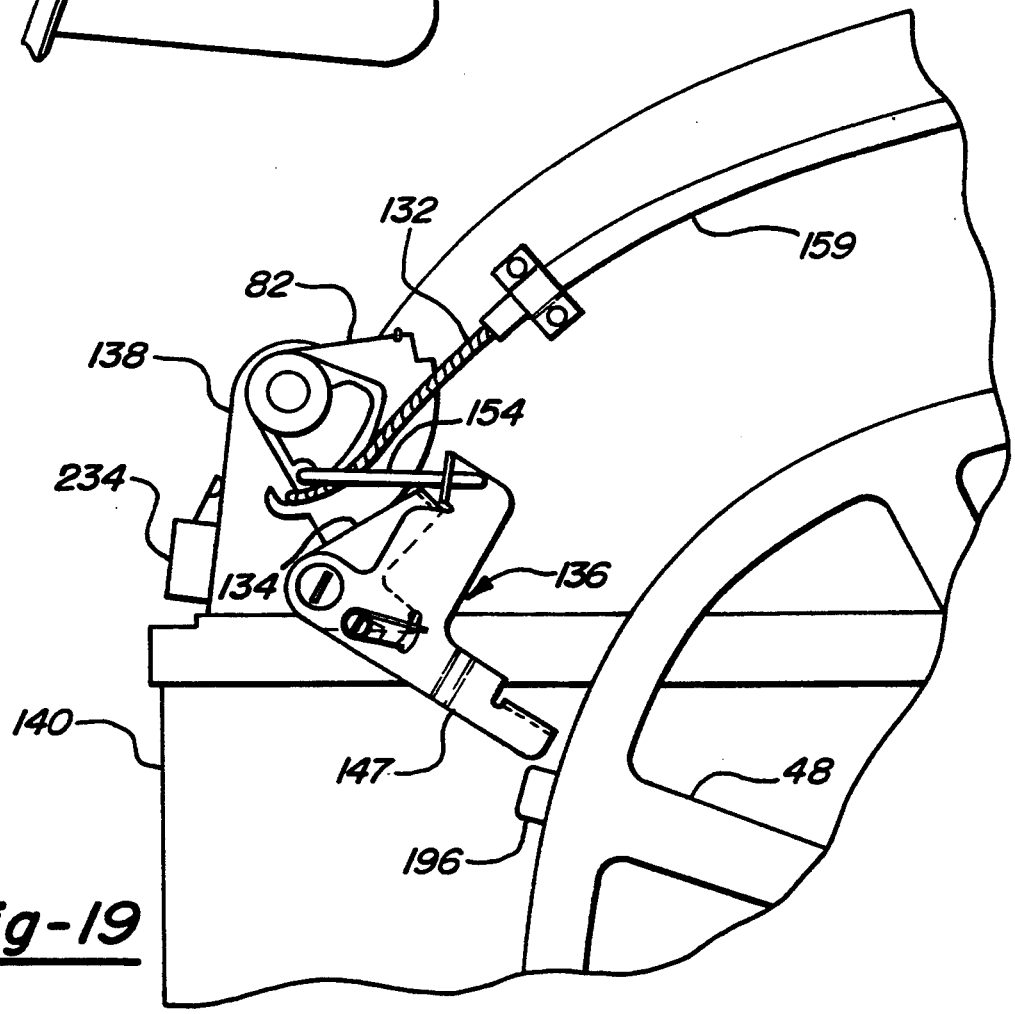
FIG. 19 is an enlarged partial side view of the tub of the present invention showing the hub in a fully rotated clockwise position.

Once the basket 28 is properly positioned and held as described above, the lid 18 may be opened for accessing the basket 28. As described above, the lid mechanism 120 is such that opening the lid 18 causes the cable 132 to move from its first rest position to its second forward position and back to the first rest position. FIGS. 18 and 19 show the effect moving the cable 132 to the second forward position has on the hub 82 rotation. As shown, the movement of the cable 132 to the second forward position rotates the hub 82 and control shaft 80 against the biasing of torsion spring 124 beyond the relative angular position "B" to a new angular position "C", such that the tab engagement arm 100 is driven to engage the door flap tab 63.

During rotation of the control shaft from position "B" to position "C", the holding arm 86 remains in its engaged position with the basket 28 while the control shaft 80 rotates relative to the holding arm 86. This is possible due to the pin and slot connection between the holding arm 86 and the control shaft 80, as described above. The resultant engagement between the tab hook 106 and the tab 63 rotates the second door flap 34 clockwise wherein the hooks 66 and 68 disengage from the apertures 64, such that the door flaps 32 and 34 are disengaged. Upon disengagement, the first door flap is urged open in response to the lid spring 56. Upon complete opening of the lid 18, the cable 132 is moved back to the first position, as described above, wherein the control shaft 80 returns to the angular position "B". This rotational movement back to angular position "B", causes the second door flap tab 63 to be released from the tab hook 106 whereupon the second door flap 34 is urged open by door spring 54.

In this fashion, therefore, opening the lid 18 results in the disengagement of the door flaps 32 and 34 such that the door flaps appear to open simultaneously with the opening of the lid 18 for accessing the basket 28. Further, the basket door opening system is a completely mechanical system, requiring no control logic or control system.

Figure 20:
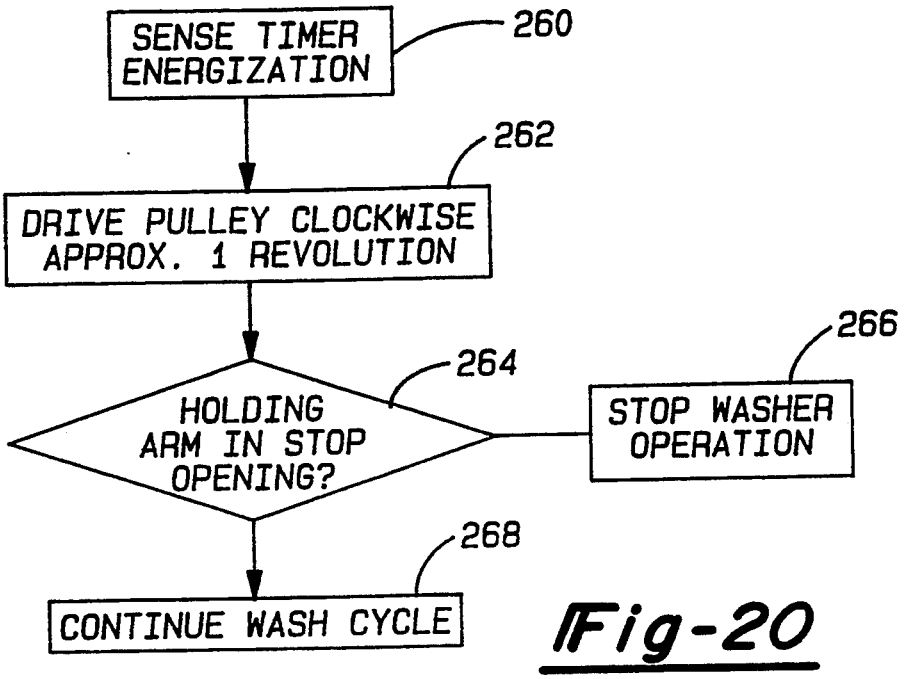
FIG. 20 is a flow chart illustrating the steps implemented by the control system of the washing machine of FIG. 8 to carry out a method of initiating basket rotation after the basket has been positioned and held.

Disengagement of the holding arm 86 from the stop opening 87 is necessary to re-initiate basket rotation after the interior of the basket 28 has been accessed. To accomplish this disengagement, the latching mechanism 84 must be reset from angular position "B" to angular position "A" such that holding arm 86 is disengaged from the basket 28. FIG. 20 illustrates the control sequence for reinitiating basket rotation during a washer power-up routine. As shown in step 260, the control board 230 senses timer energization. In step 262, the motor 46 is energized to drive the pulley clockwise approximately one revolution. Due to the above described basket positioning system, at the initiation of the washer power-up, when wash basket rotation is desired after the basket has been positioned and held, the trip arm 192 is positioned angularly in a counter-clockwise direction just beyond the first arm portion 147.

The clockwise rotation of the pulley operates to reset latching mechanism 84 and thereby reset the holding arm 86 in its disengaged position. Due to the limited relative rotation provided between the pulley 48 and the drive hub 184, the pulley 48 rotates about the drive hub 184 until the drive dog 186 is driven into the surface 190*a*. The trip arm 192 remains in the radially extended position until the cam follower end 194 engages the cam surface 202 and moves to the inner track 204. This results, therefore, in the trip end 196 engaging the first arm portion 147 in a clockwise direction, causing the tripping lever 136 to rotate in a counter-clockwise direction about the shaft 138. The interconnection between the tripping lever 136 and the hub 82 through rod 154 is such that the counter-clockwise rotation of the tripping lever 136 drives the hub 82 to rotate in a clockwise rotation. The latch lever 134 rides along the outer surface 127 of the hub 82 until the hub 82 has rotated the control shaft 80 back to the angular position "A" wherein the catch flange engages the notch 126. This clockwise rotation of the control shaft 80 disengages the holding arm 86 from the stop opening 87.

Disengagement of the holding arm 86 from the stop opening 87 may be sensed by sensing hub rotation with the hub switch 234, as shown in step 264. In step 266, if the hub switch 234 does not sense the hub rotation, indicating a failure mode, the machine is deenergized. However, if as expected, the hub switch 234 senses hub rotation to angular position "A", the wash cycle continues, as shown in step 268.

In this fashion, the latching mechanism is reset by clockwise rotation of the pulley 48 while the trip arm 192 remains in the radially extending position. However, as described above, after a limited relative rotation between the pulley 48 and hub 184, the trip arm 192 returns to its disengaged position such that successive relative rotation of the trip end 196 past the tripping lever 136 does not result in contact between the trip end 196 and the first arm position 147.

Figure 21:
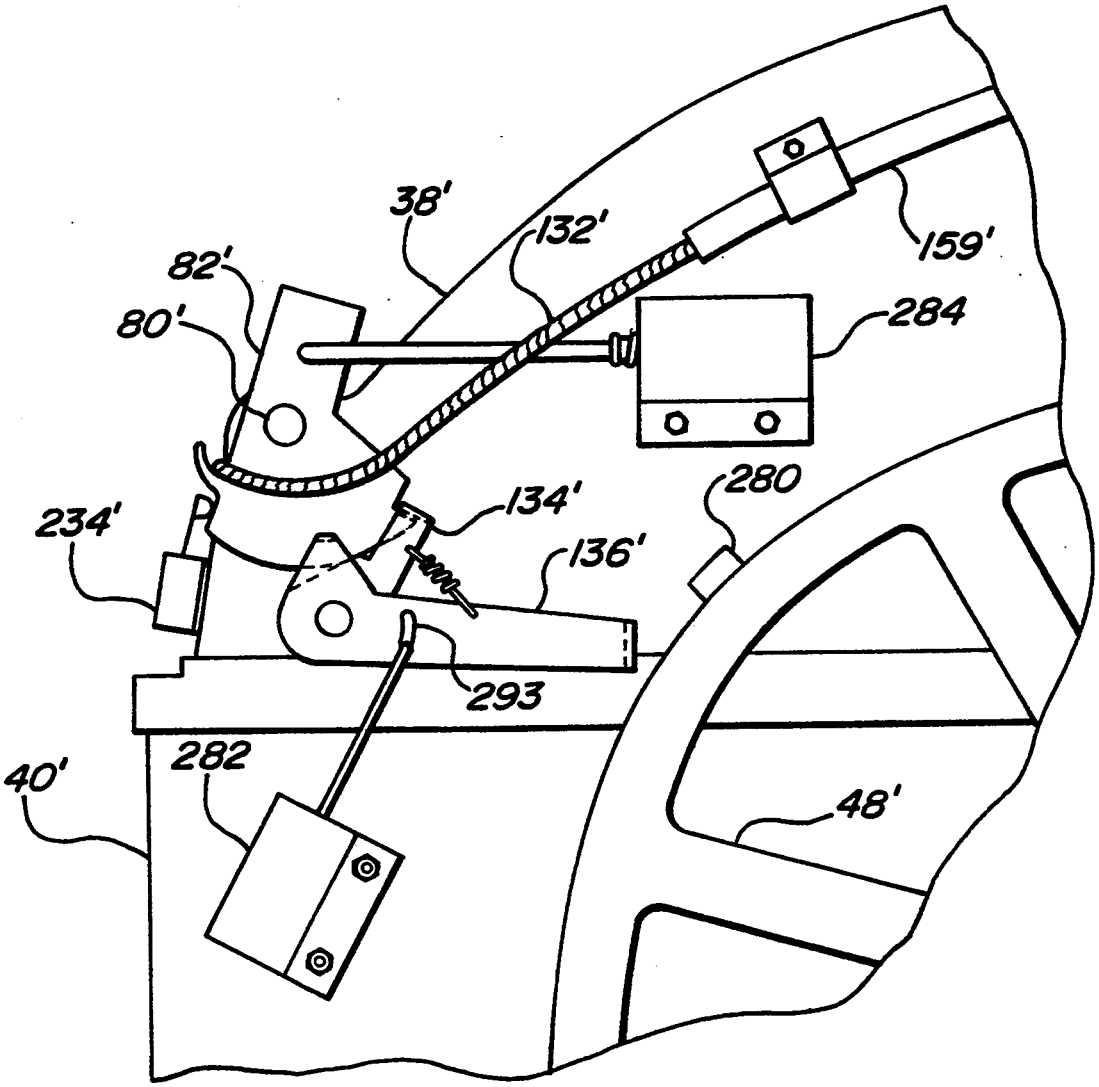
FIG. 21 is a partial side elevational view of the automatic washer of FIG. 1, illustrating an alternative embodiment of the present invention.

In FIG. 21 an alternative embodiment of the present invention is illustrated. In this system, the strictly mechanical latching mechanism 84, described above, is replaced with a latching system including electromechanical elements.

As shown, the latching mechanism of the alternative embodiment includes a latching lever 134' and a tripping lever 136' for operation in a similar fashion to the latching lever 134 and the tripping lever 136. A hub 82' is provided rigidly attached to a shaft 80' for controlling the angular position of the the shaft 80'. Attached to the shaft 80' are a holding arm 86' and elements for opening the basket doors similar to those described above.

In contrast to the two piece pulley system described above, however, the alternative embodiment includes a single piece pulley 48' having a fixed trip member 280 for engaging the tripping lever 136'. A trip solenoid 282 is interconnected with the tripping lever 136' for selectively positioning the tripping lever 136' in a position for engagement with the trip member 280. In contrast to the tripping lever 136, the tripping lever 136' must be rotated clockwise toward the pulley 48' for engagement with the trip member 280 and rotated away from the pulley during normal washer operation when engagement between the trip member 280 and the tripping lever 136' is not desired. Further, a reset solenoid 284 is connected with the hub 82' for resetting the hub thereby disengaging the holding arm 86' from a stop opening 87'.

Figure 22:
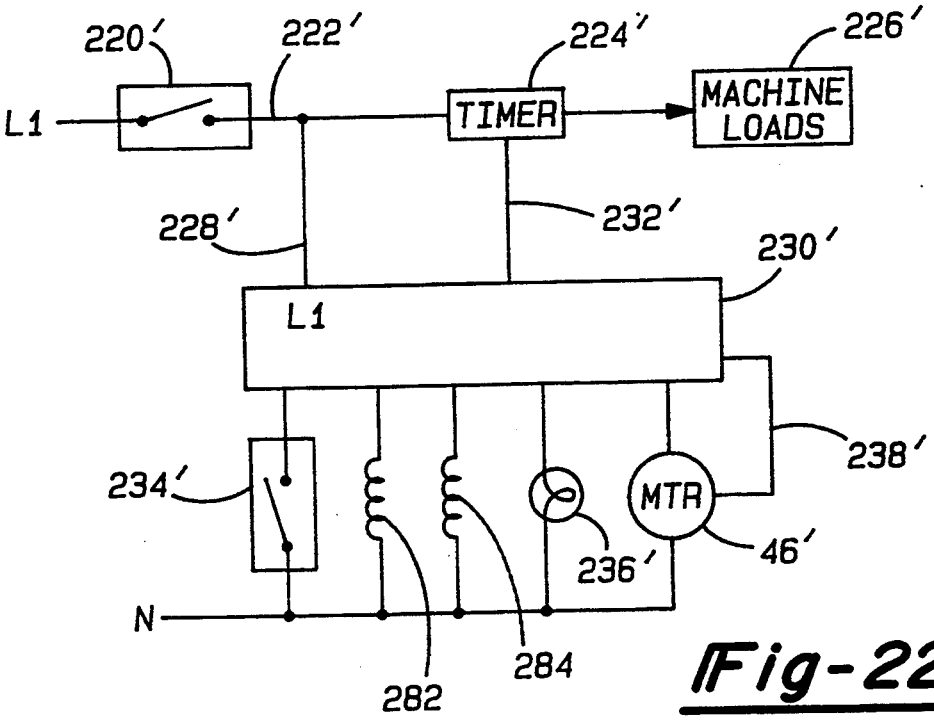
FIG. 22 is a circuit diagram for the alternative embodiment of the automatic washer automatic washer of FIG. 21.

The circuit diagram of the control system for the alternative embodiment, illustrated in FIG. 22, is similar to FIG. 14. However, the solenoids 282 and 284 are included in the circuit, interconnected with a control board 230' for selective energization.

Figure 23:
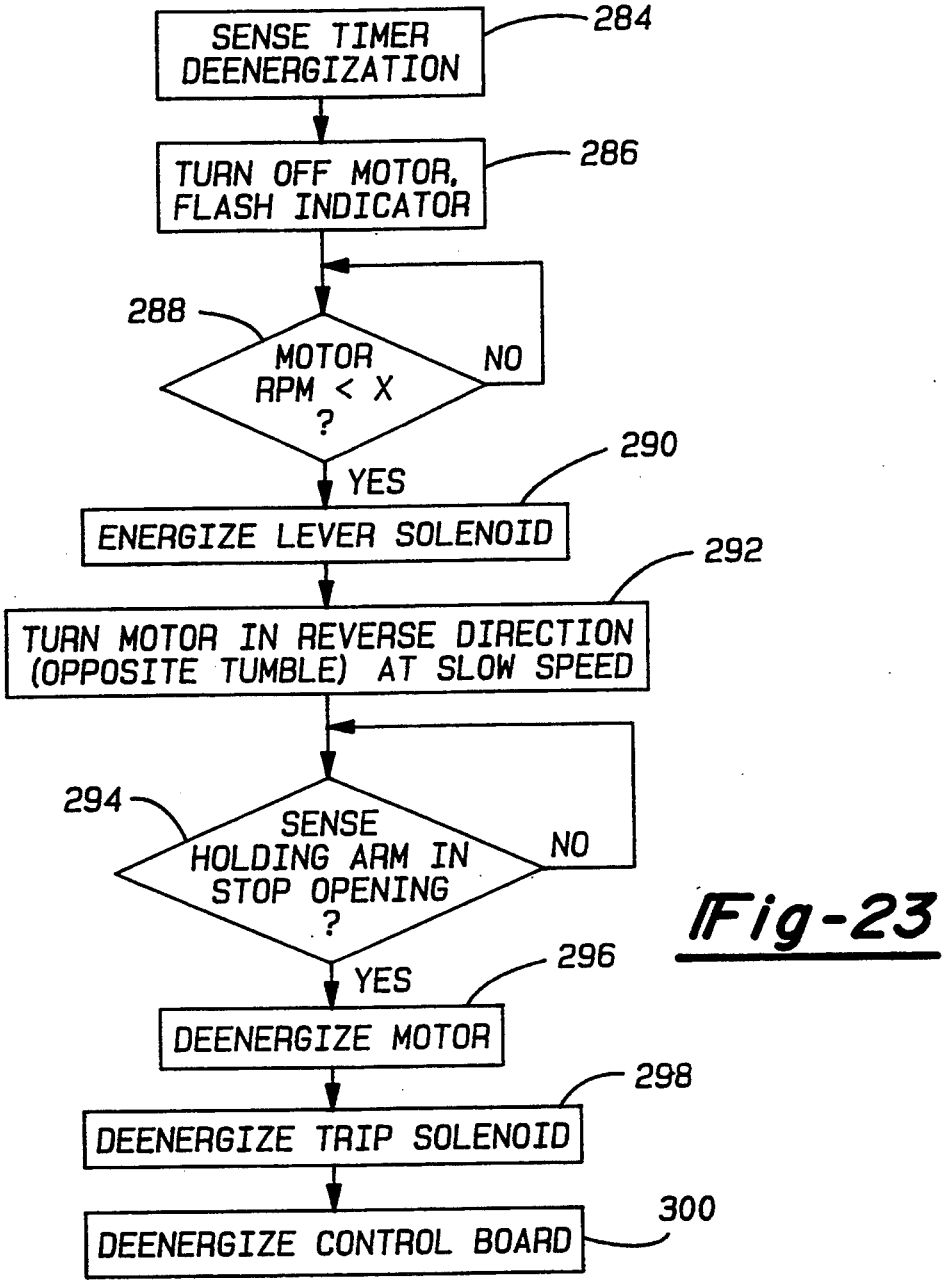
FIG. 23 is a flow chart illustrating the steps implemented by the control system of the washing machine of FIG. 21 to carry out a method of positioning the wash basket according to the present invention.

The operation of the alternative embodiment may be understood by referring to FIG. 23. In step 284, 286 and 288 timer deenergization is sensed, the motor 46' is deenergized, the indicator light 236' is flashed and the motor speed is sensed, in similar fashion to as described above with regard to steps 242, 244 and 246. Once the motor 46' has stopped and the basket 28' has stopped rotating, the trip solenoid 282 is energized by the control board 230' as shown in step 290, such that the tripping lever 136' is rotated down into a position for engagement with the trip member 280. In step 292, the motor is driven in a direction for driving the pulley 48' in a counter-clockwise direction. In this manner, the trip member 280 is driven into the tripping lever 136' thereby rotating the tripping lever 136' in a clockwise direction. This clockwise rotation of the tripping lever 136' is allowed by providing a slot 293 for slotted engagement with the trip solenoid 282. In a like manner to the description above regarding the rotation of the tripping lever 136, the rotation of the tripping lever 136' causes the holding arm 86' to drive into the rotating basket 28' for engagement with a stop opening 87' thereby positioning and holding the basket 28'.

In step 294, the holding arm engagement is sensed through a micro-switch 234' or through a locked rotor motor condition, as described above. Subsequently, in step 296, the motor 46' is deenergized and in step 298 the trip solenoid 282 is deenergized, moving the tripping lever 136' away from the pulley 48'. Finally, as shown in step 300, the control board is deenergized.

Figure 24:
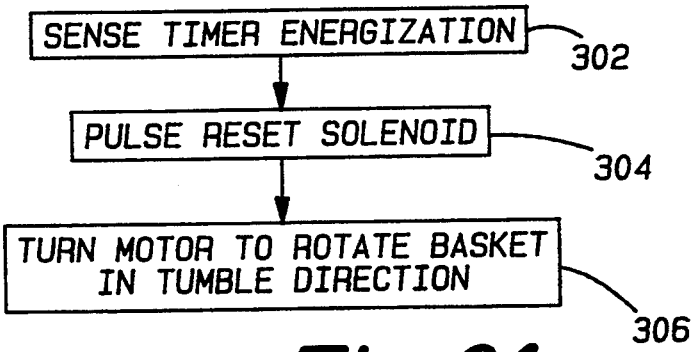
FIG. 24 is a flow chart illustrating the steps implemented by the control system of the washing machine of FIG. 21 to carry out a method of initiating basket rotation after the basket has been positioned and held.

As can be understood by one skilled in the art, prior to reinitiating basket rotation, the holding arm 86' must be disengaged from the stop opening 87'. In FIG. 24, the power-up routine for the alternative embodiment of the present invention is illustrated. In step 302, timer energization is sensed by the control board 230'. In step 304, the reset solenoid 284 is momentarily energized or pulsed, which rotates the hub 82' and control shaft 80' in a clockwise direction, disengaging the holding arm 86' from the stop opening 87' and allowing the latching lever 134' to engage a hub notch for holding the hub 82' in an angular position "A'" such that the holding arm is disengaged from the basket 28'. In step 306 the motor is energized for initiating the wash basket 28' rotation and subsequently operating the washer 10 in the selected wash cycle.

It can be seen, therefore, that the present invention provides a pulley system for selectively actuating and resetting the a latching mechanism provided on a wash basket in a top loading horizontal axis washer. Further, it can be seen that the present invention provides a pulley system having a trip arm which may be selectively moved to extend beyond the outer diameter of the pulley for engaging a latching system on an automatic washer.

Although the present invention has been described with reference to a specific embodiment, those of skill in the art will recognize that changes may be made thereto without departing from the scope and spirit of the invention as set forth in the appended claims. It should be understood, therefore, that we wish to embody within the scope of the patent warranted hereon all such modifications as reasonably and properly come within the scope of our contribution to the art.

We claim:

1. A pulley system for an automatic washer wherein the automatic washer includes a wash basket rotatably disposed within a tub and a motor having a motor shaft for selectively rotating the wash basket about a horizontal axis, the pulley system being disposed between said motor and said basket for drivingly connecting said motor with said basket, said pulley system comprising:

a drive hub disposed external of said tub and being drivingly interconnected with wash basket;

a pulley having an inner surface slidably disposed about the outer diameter of said drive hub such that said pulley may rotate a predetermined angular distance about said hub before drivingly engaging said drive hub for co-rotation;

a trip arm interconnected with said drive hub and said pulley and being adapted for selective partial extension beyond the outer periphery of said pulley in response to the direction of wash basket rotation; and a belt drivingly disposed about said motor shaft and said pulley for drivingly interconnecting said motor with said pulley.

2. The pulley system according to claim 1, further comprising:

a drive shaft rotatably extending through said tub from said wash basket, said hub being drivingly connected to said drive shaft for driving said wash basket.

3. The pulley system according to claim 1, further comprising:

said drive hub having a slot formed into the outer diameter thereof, said slot having end walls; and a drive dog extending inwardly from the inner surface of said pulley for riding within said slot wherein engagement between said drive dog and one of said end walls causes said driving engagement between said pulley and said drive hub.

4. The pulley system according to claim 1, further comprising:

means for fastening said trip arm to said pulley for securing said trip arm for co-rotation with said pulley and for allowing radial movement of said trip arm relative to said pulley;

said drive hub further including a track having an inner track portion, an outer track portion and a cam portion; and said trip arm having a cam follower end disposed in said track, said trip arm further having a trip end opposite said cam follower end;

wherein relative rotation between said drive hub and said pulley moves said cam follower end within said track such that in a first direction of wash basket rotation said cam follower end is positioned in said inner track such that said trip end is disposed radially within the outer periphery of said pulley and in a second direction of wash basket rotation said cam follower end is positioned in said outer track such that said trip end is disposed radially beyond the outer diameter of said pulley.

5. A pulley system for an automatic washer wherein the automatic washer includes a wash basket rotatably disposed within a tub and a motor having a motor shaft for selectively rotating the wash basket about a horizontal axis, the pulley system being disposed between said motor and said basket for drivingly connecting said motor with said basket, said pulley system comprising:

a pulley disposed external of said tub and being drivingly interconnected with said wash basket;

a trip arm interconnected with said pulley;

means for selectively extending a portion of said trip arm beyond the outer periphery of said pulley in response to the direction of wash basket rotation; and a belt drivingly disposed about said motor shaft and said pulley for drivingly interconnecting said motor with said pulley.

6. The pulley system according to claim 5, further comprising:

a drive shaft rotatably extending through said tub from said wash basket; and a drive hub disposed external of said tub and being drivingly interconnected with drive shaft for driving said wash basket, said pulley having an inner diameter slidably disposed about the outer diameter of said drive hub such that said pulley may rotate a predetermined angular distance about said hub before drivingly engaging said drive hub for co-rotation.

7. The pulley system according to claim 6, further comprising:

said drive hub having a slot formed into the outer surface thereof, said slot having end walls; and a drive dog extending inwardly from the inner surface of said pulley for riding within said slot wherein engagement between said drive dog and one of said end walls causes said driving engagement between said pulley and said drive hub.

8. The pulley system according to claim 6, further comprising:

means for fastening said trip arm to said pulley for securing said trip arm for co-rotation with said pulley and for allowing radial movement of said trip arm relative to said pulley;

said drive hub further including a track having an inner track portion, an outer track portion and a cam portion; and said trip arm having a cam follower end disposed in said track, said trip arm further having a trip end opposite said cam follower end;

wherein relative rotation between said drive hub and said pulley moves said cam follower end within said track such that in a first direction of wash basket rotation said cam follower end is positioned in said inner track such that said trip end is disposed radially within the outer periphery of said pulley and in a second direction of wash basket rotation said cam follower end is positioned in said outer track such that said trip end is disposed radially beyond the outer diameter of said pulley.

9. An automatic washer, comprising:

an imperforate tub;

a perforate wash basket disposed within said tub being rotatable about a horizontal axis;

a motor drivingly connected with said wash basket for selectively driving said wash basket about said horizontal axis;

a control shaft rotatably supported by said tub and having a main portion disposed adjacent said basket and an end extending external of said tub;

a plurality of elements interconnected with said control shaft for rotation therewith for controlling the operation of the washer;

a spring for biasing said control shaft to rotate such that said plurality of elements are urged toward said basket;

a hub rigidly attached to said externally extending end of said control shaft adapted for selectively controlling the angular position of said control shaft relative to said tub;

a latching mechanism disposed adjacent said hub for latching said hub in a predetermined angular position against the rotational bias of said control shaft; and means for tripping said latching mechanism such that said hub is released such that said control shaft rotates under the urgings of said spring.

10. An automatic washer according to claim 9 wherein said latching mechanism further comprises:

a latching lever rotatably supported adjacent said hub for engaging said hub in said predetermined angular position; and a tripping lever rotatably supported adjacent said latching lever and interconnected with said latching lever for rotation with said latching lever, said tripping lever having a portion extending generally inwardly toward the center of the wash basket.

11. The automatic washer according to claim 10, further comprising:

a pulley drivingly interconnected with said basket and and said motor for rotating said basket;

a trip arm interconnected with said pulley and having a trip end extending from said pulley;

a trip solenoid supported by said tub and being interconnected with said tripping lever such that said tripping lever may be selectively rotated toward said pulley such that when said tripping arm is drawn toward said pulley said trip end engages said tripping lever when said trip end is rotated past said tripping lever; and a reset solenoid supported by said tub and being interconnected with said hub for drawing said hub back to said predetermined angular position wherein said latching mechanism latches said hub.

12. The automatic washer according to claim 10 further comprising:

a pulley system disposed between said motor and said wash basket for rotating said basket and further including means for tripping and resetting said latching mechanism, said pulley system comprising:

a pulley disposed external of said tub and being drivingly interconnected with said wash basket;

a belt drivingly disposed about said motor shaft and said pulley for drivingly interconnecting said motor with said pulley;

a trip arm interconnected with said pulley; and means for selectively extending a portion of said trip arm beyond the outer periphery of said pulley in response to the direction of wash basket rotation such that said trip arm may selectively engage said tripping lever for tripping and resetting said latching mechanism.

13. The automatic washer according to claim 12, further comprising:

a drive shaft rotatably extending through said tub from said wash basket; and a drive hub disposed external of said tub and being drivingly interconnected with drive shaft for driving said wash basket, said pulley having an inner surface slidably disposed about the outer diameter of said drive hub such that said pulley may rotate a predetermined angular distance about said hub before drivingly engaging said drive hub for co-rotation.

14. The automatic washer according to claim 13, further comprising:

said drive hub having a slot formed into the outer diameter thereof, said slot having end walls; and a drive dog extending inwardly from the inner surface of said pulley for riding within said slot wherein engagement between said drive dog and one of said end walls causes said driving engagement between said pulley and said drive hub.

15. The automatic washer according to claim 14, further comprising:

means for fastening said trip arm to said pulley for securing said trip arm for co-rotation with said pulley and for allowing radial movement of said trip arm relative to said pulley;

said drive hub further including a track having an inner track portion, an outer track portion and a cam portion; and said trip arm having a cam follower end disposed in said track, said trip arm further having a trip end opposite said cam follower end;

wherein relative rotation between said drive hub and said pulley moves said cam follower end within said track such that in a first direction of wash basket rotation said cam follower end is positioned in said inner track such that said trip end is disposed radially within the outer periphery of said pulley and in a second direction of wash basket rotation said cam follower end is positioned in said outer track such that said trip end is disposed radially beyond the outer diameter of said pulley.

* * * * *